US007505026B2

(12) United States Patent
Baba et al.

(10) Patent No.: US 7,505,026 B2
(45) Date of Patent: Mar. 17, 2009

(54) IMAGE DISPLAY DEVICE AND METHOD OF DISPLAYING IMAGE

(75) Inventors: Masahiro Baba, Kanagawa (JP); Go Ito, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 698 days.

(21) Appl. No.: 11/187,004

(22) Filed: Jul. 22, 2005

(65) Prior Publication Data

US 2006/0146005 A1 Jul. 6, 2006

(30) Foreign Application Priority Data

Jan. 6, 2005 (JP) ..... 2005-001901

(51) Int. Cl.
*G09G 3/36* (2006.01)

(52) U.S. Cl. ..... 345/102; 345/89; 345/690

(58) Field of Classification Search ..... 345/76, 345/77, 87–89, 102, 204, 690
See application file for complete search history.

(56) References Cited

U.S. PATENT DOCUMENTS

| | | | | |
|---|---|---|---|---|
| 6,724,358 | B2 * | 4/2004 | Ban et al. | 345/92 |
| 7,106,249 | B2 * | 9/2006 | Kubo et al. | 342/174 |
| 7,106,350 | B2 * | 9/2006 | Baba et al. | 345/691 |
| 7,184,065 | B2 * | 2/2007 | Shin | 345/690 |
| 7,330,172 | B2 * | 2/2008 | Itoh et al. | 345/102 |
| 7,382,341 | B2 * | 6/2008 | Park | 345/77 |
| 2002/0003522 | A1 | 1/2002 | Baba et al. | |
| 2002/0015104 | A1 | 2/2002 | Itoh et al. | |
| 2003/0006948 | A1 * | 1/2003 | Son et al. | 345/87 |
| 2004/0041751 | A1 * | 3/2004 | Takahashi | 345/76 |
| 2004/0246242 | A1 * | 12/2004 | Sasaki | 345/204 |
| 2005/0007389 | A1 * | 1/2005 | Kumamoto et al. | 345/690 |
| 2005/0083435 | A1 | 4/2005 | Itoh et al. | |

FOREIGN PATENT DOCUMENTS

| | | |
|---|---|---|
| JP | 11-109921 | 4/1999 |
| JP | 2002-123223 | 4/2002 |

* cited by examiner

*Primary Examiner*—Richard Hjerpe
*Assistant Examiner*—Tom V Sheng
(74) *Attorney, Agent, or Firm*—Finnegan, Henderson, Farabow, Garrett & Dunner, L.L.P.

(57) ABSTRACT

It is an object of the invention to provide an image display device for improving the image quality of moving images and still images displayed on a liquid crystal display device while controlling increase in power consumption. A liquid crystal panel for performing input image display and black image display at an arbitrary black display time ratio in one frame period, a movement detection unit for detecting a movement of the input image and outputting movement information, a display ratio control unit for fixing the black display time ratio based on the movement information, and a display brightness control unit for controlling brightness of the liquid crystal panel for one frame period to be substantially constant irrespective of the black display period are provided. The movement detection unit detects whether the input image is a moving image or a still image, and the display ratio control unit sets at least one transient black display time ratio between the black display time ratios for the moving image and the still image which is determined according to the result of the movement detection unit, so that the black display time ratio changes midway to the transient black display time ratio in the period when the black display time ratio is switched between the moving image and the still image.

38 Claims, 18 Drawing Sheets

IMAGE DISPLAY DEVICE AND METHOD OF DISPLAYING IMAGE

CROSS-REFERENCE TO RELATED APPLICATIONS

This application is based upon and claims the benefit of priority from the prior Japanese Patent Application No. 2005-1901, filed on Jan. 6, 2005, the entire contents of which are incorporated herein by reference.

BACKGROUND OF THE INVENTION

1. Field of the Invention

The present invention relates to an image display device and a method of displaying an image in which the qualities of moving image and still image are improved while controlling increase in power consumption.

2. Description of the Related Art

In recent years, offering of technical advantages to flat panel display devices, such as liquid crystal display devices or organic electro luminescence (EL) display devices, are in progress, and such display devices are becoming widely used in the field of TV-set in which cathode ray tubes (hereinafter referred to as CRT) have been mainly used.

However, the liquid crystal display devices or the organic EL display devices have a problem such that images are percieved to be out-of-focus when moving images are displayed. This problem is caused by the fact that time-axis characteristics in method of displaying image are different between the liquid crystal display device or the organic EL display device and the CRT. The cause of this problem will be described briefly below.

The liquid crystal display device or the organic EL display device using a transistor as a change-over switch for switching between display and non-display for each pixel is a display device employing a display method in which a displayed image is maintained for one frame period corresponding to one frame (hereinafter referred to as hold-type display). On the other hand, the CRT is a display device employing a display method in which each pixel is turned on for certain period and then is darkened (hereinafter referred to as impulse-type display).

In the case of the hold-type display, a state in which the same image is kept displayed from the timing where one frame is displayed to the timing where the next frame is displayed in the moving image is resulted. From the timing where a frame N in the moving image is displayed until the timing where a next frame N+1 is displayed (between frames), the same image as in the frame N is kept displayed. When a moving object is shown in the moving image, the moving object stands still from the timing where the frame N is displayed until the timing where the frame N+1 is displayed on a screen. When the frame N+1 is displayed, the moving object moves discontinuously.

On the other hand, when the observer pays attention to the moving object and keeps observing while following the movement of the moving object (when the ocular movement of the observer is the following movement), the observer moves his/her eyes and tries to follow the moving object with continuous smoothness without consciousness.

Then, there arises a difference between the movement of the moving object on the screen and the movement of the moving object which the observer expects. Due to this difference, a shifted image is percieved to retinas of the observer according to the speed of the moving object. Since the observer perceives a shift image on which the shifted image is superimposed, he/she gets the impression that the moving image is out-of-focus.

The higher the speed of the moving image, the larger shift amount of the image is percieved on his/her retinas, and hence the observer gets the stronger impression of out-of-focus.

In the case of the impulse-type display, such "out-of-focus" does not occur. It is because black color is displayed between the frames (for example, between the frame N and the frame N+1 described above) of the moving image in the case of the impulse-type display.

By displaying black between the frames, even when the observer moves his/her eyes to follow the moving object smoothly, the observer is not viewing the image other than the moment when the image is displayed. Since the observer recognizes each frame of the moving image as an independent image, the image percieved on his/her retinas is never be shifted.

In order to solve the above-described problem in the display device in which the hold-type display is performed, a technique to display "black" by any means after having displayed a frame (for example, see Japanese Patent Publication (KOKAI) No. JP-A-11-109921) is proposed.

There is also proposed a technique to determine whether the input image is moving image or still image and only when it is the moving image, display black between the consecutive frames (For example, see Japanese Patent Publication (KOKAI) No. JP-A-2002-123223).

In JP-A-11-109921, by providing "black" screen intentionally between the frames on the liquid crystal display, a quasi-impulse-type display as the CRT is created to restrain deterioration of the image quality of the moving image. However, a power consumed by a backlight which is continuously turned on during black display is wasted. Also, in the case of the still image, there arises such problem that flicker which is caused by the impulse-type display may occur.

In JP-A-2002-123223, in order to solve the above-described problem, it is controlled in such a manner that the hold-type display is employed for the still image display and the impulse-type display is employed for the moving image display. However, in the above-described method, for example, black is displayed in the same manner for the moving image with small motion and for the moving image with large motion, sufficient effect for reducing power consumption cannot be expected. Although the criteria between the moving image and the still image may be set to a value rather closer to the moving image in order to increase the effect for reducing power consumption, the quality of the moving image is deteriorated in this case. In addition, the abrupt change in a black display time ratio (black display period/one frame period) such as the change-over between the impulse display and the hold display are recognized as the flicker by the observers, which may result in deterioration of the image quality.

BRIEF SUMMARY OF THE INVENTION

According to one embodiment of the invention, there is provided an image display device including: an image input processor for inputting an input image; a display ratio control processor for controlling a black display time ratio which is a ratio of period for displaying black in one frame period in a frame of the input image; a period setting processor for setting a black display period and an image display period for displaying the frame from the black display time ratio; a brightness compensation processor for obtaining brightness compensation information for compensating brightness of the frame according to the black display time ratio; and a display for displaying the frame and the black image, wherein the display ratio control processor includes: a ratio fixing processor for fixing the black display time ratio; a transient black display time ratio calculating processor for obtaining a transient black display time ratio, which is a ratio between a current black display time ratio determined by the ratio fixing processor and a new black display time ratio fixed by the ratio fixing processor; and a transient black display time ratio setting processor for setting the black display time ratio relating at least to the display in one frame to the transient black display time ratio and then setting the black display time ratio to the new black display time ratio, and the display displays a brightness compensation image based on the brightness compensation information and the frame in the image display period, and displays the black image in the black display period.

DETAILED DESCRIPTION OF THE INVENTION

Figure 1:
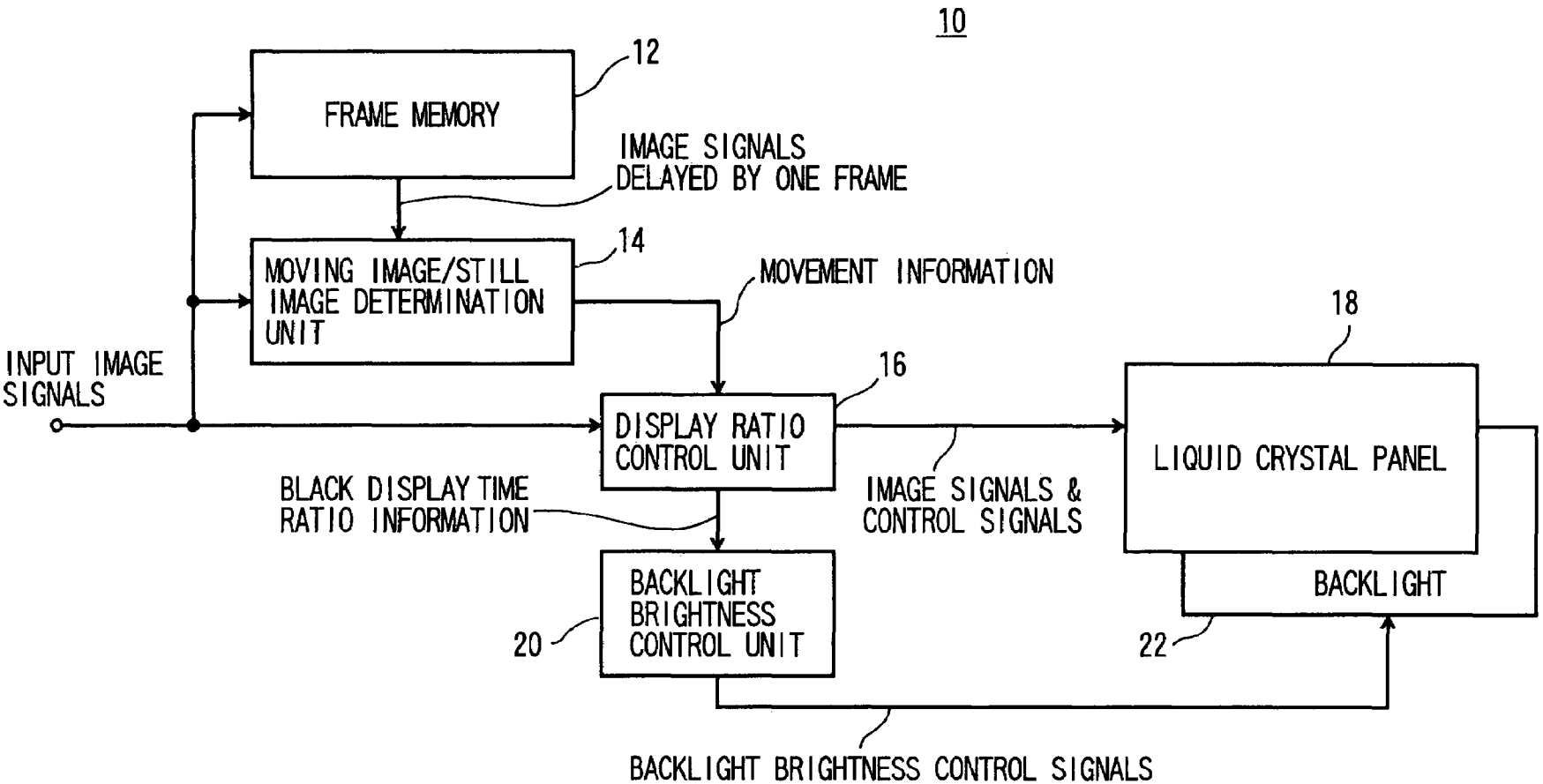
FIG. 1 is a drawing showing a structure of a liquid crystal display device according to a first embodiment of the invention.

Referring now to the drawings, embodiments of an image display device according to the invention will be described below.

First Embodiment

Referring now to FIG. 1 to FIG. 12, a liquid crystal display device 10 according to a first embodiment of the invention will be described.

(1) Structure of the Liquid Crystal Display Device 10

The structure of the liquid crystal display device 10 according to the first embodiment of the invention will be described in FIG. 1.

The input image signal is inputted to a frame memory 12, a moving image/still image determination unit 14, and a display ratio control unit 16.

The frame memory 12 holds input image signals for one frame period, and outputs the same to the moving image/still image determination unit 14 as the image signals delayed by one frame. The term "one frame" used herein represents one image which is displayed on the liquid crystal display device 10, and hence one field which is generally referred in relation to interlaced image signals and one frame used herein represent the identical meaning.

The moving image/still image determination unit 14 detects moving image/still image between two frames temporally adjacent to each other using image signals delayed by one frame period by the input image signals and the frame memory 12, and outputs the results to the display ratio control unit 16 as movement information.

The display ratio control unit 16 fixes a display ratio of black display to be displayed between the frames of the input image signals displayed on a liquid crystal panel 18 with respect to one frame period (black display period ratio) based on inputted movement information, and outputs the determined display ratio to a backlight brightness control unit as black display time ratio information. Image signals and control signals (horizontal synchronous signals, vertical synchronous signals) are also outputted to the liquid crystal panel 18.

The backlight brightness control unit 20 fixes the brightness of a backlight 22 based on the inputted black display time ratio information, and outputs the determined brightness to the backlight 22 as backlight brightness control signals. The liquid crystal panel 18 displays image signals with black displays interposed between the frames based on the input image signals and the control signals. The backlight 22 emits light at a brightness based on the backlight brightness control signals.

The operation of the respective parts will be described below.

(2) Moving Image/Still Image Determination Unit 14

The moving image/still image determination unit 14 detects the moving images/still images using a plurality of frames of the input image signals and outputs the detected images as the movement information.

In this embodiment, the input image signals are stored for one frame period in the frame memory 12 and detect the moving images/still images using the image signals and the input image signals delayed by one frame, that is, using the two temporally adjacent frames. However, the frames for detecting the moving images/still images are not limited to the temporally consecutive two frames, and detection of the moving images/still images may be achieved by using only frames of even number or frames of odd number when the input image signals are interlaced image signals.

Although various moving image/still image detecting means may be considered, in this embodiment, detection whether or not the input image was the moving image or the still image was performed by obtaining the Summation of Absolute Differences between the two frames, and conducting threshold processing for the Summation of Absolute Differences. In other words, the Summation of Absolute Differences between the $N^{th}$ frame and the $N+1^{th}$ frame having the number of pixels X in the horizontal direction and the number of pixels Y in the vertical direction is formularized as Expression 1.

$$SAD = \sum_{u=1}^{X} \sum_{v=1}^{Y} |f(u, v, N) - f(u, v, N+1)| \quad \text{[Expression 1]}$$

SAD represents the Summation of Absolute Differences, and f(u,v,n) represents the pixel value Y at the position (u,v) of the $n^{th}$ frame. The term f(u,v,n) can be formularized as Expression 2 as a linear summation of the pixel values (gray-scale level) of red, green and blue.

$$f(u,v,n)=0.299R(u,v,n)+0.587G(u,v,n)+0.114B(u,v,n) \quad \text{[Expression 2]}$$

The terms R(u,v,n), G(u,v,n), B(u,v,n) represent the pixel values of red, green and blue at positions (u,v) respectively. Although this embodiment is adapted to obtain the Summation of Absolute Differences of the value Y, it can also be adapted to obtain the Summation of Absolute Differences of the pixel values of red, green and blue.

Although this embodiment is adapted to obtain the Summation of Absolute Differences with respect to all the pixels in one frame, it can also be adapted to obtain the Summation of Absolute Differences only with respect to discrete pixels or to reduce one frame and obtain the Summation of Absolute Differences for the reduced size image for simplifying the processing. The Summation of Absolute Differences between frames may be obtained every two or other plurality of frames, other than between the adjacent frames.

Also, in order to make the movement robust, movement information of the current frame can be fixed using the movement information of several frames in the past. For example, assuming that the still image is 0 and the moving image is 1 as the movement information, median processing is performed from the movement information of five frames in the past, and the movement information of the median is employed as the movement information of the current frame. With the processing as described above, even when only a certain still frame is detected as a moving image due to failure of movement detection, the received result of movement detection is "still image" after having performed the median processing. The threshold processing is performed for the Summation of Absolute Differences obtained by the Expression 1, and whether or not the input image is the moving image or the still image is detected. In other words, when the Summation of Absolute Differences is a predetermined threshold or higher, it is determined as the moving image and when the Summation of Absolute Differences is lower than the predetermine threshold, it is determined as the still image. The result of determination between the moving image and the still image is inputted to the display ratio control unit 16 as the movement information.

(3) Display Ratio Control Unit 16

The display ratio control unit 16 determines the black display time ratio based on the inputted movement information.

In this embodiment, the black display time ratio for the still image is assumed to be 0% and the black display time ratio for the moving image is assumed to be 50%. The change in the black display time ratio in this embodiment in the case where the movement information is changed from the still image to the moving image will be described.

(3-1) When the Movement Information is Changed from the Still Image to the Moving Image The case in which the movement information is changed from the still image to the moving image will be described first.

When the movement information is changed from the still image to the moving image, the black display time ratio is changed from 0% to 50%. When the ratio is changed immediately from 0% to 50%, flicker may occur due to the abrupt change in the black display time ratio. Therefore, in this embodiment, when the black display time ratio is changed, a transient black display time ratio is set between the black display time ratio for the still image (0%) and the black display time ratio for the moving image (50%) to cause the black display time ratio to change via the transient black display time ratio.

Figure 2:
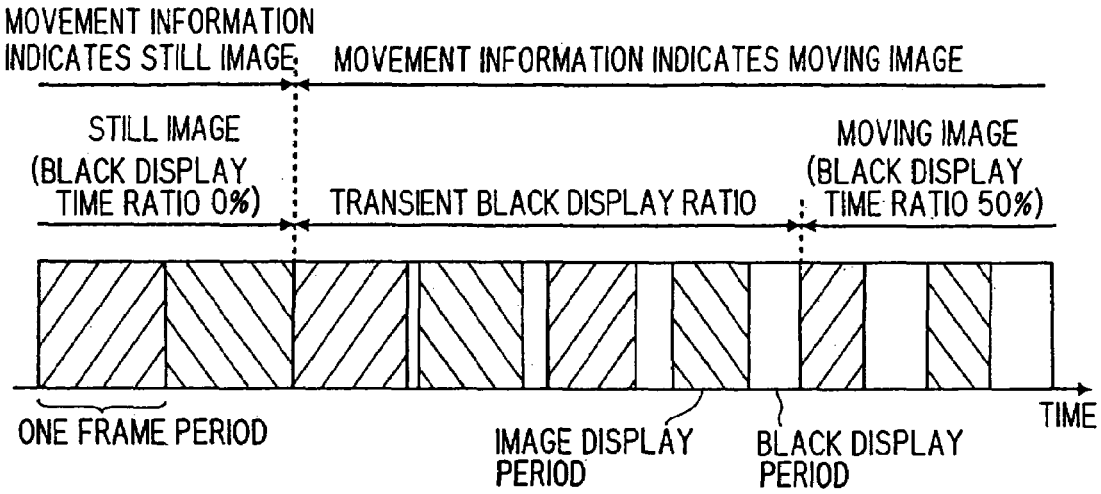
FIG. 2 is a drawing showing an operation in the first embodiment.

FIG. 2 is a pattern diagram showing a display state when the ratio is changed from the black display time ratio for the still image to the black display time ratio for the moving image.

Assuming that the movement information is changed from the sill image to the moving image at the third frame in FIG. 2, since the black display time ratio is 0% for the still image, the image is displayed for the entire one frame period. When the movement information is changed to the moving image, the black display time ratio becomes 50%.

However, by setting the transient black display time ratio between the black display time ratio 0% and the black display time ratio 50% so as to prevent abrupt change in black display time ratio and cause the black display time ratio to change gradually. The amount of change in the black display time ratio during one frame is preferably set to a value below the minimum visibility so that the flicker due to the change in the black display time ratio is not visible. Minimum visibility may change depending on the brightness or the like of the display device. However, in FIG. 2, the amount of change in the transient black display time ratio in one frame is set to be 10%. Therefore, the transient black display time ratios of 10%, 20%, 30% and 40% are set between the black display time ratio of 0% and the black display time ratio of 50%. In this arrangement, the abrupt change in the black display time ratio can be restrained and occurrence of flicker can be prevented.

Figure 3:
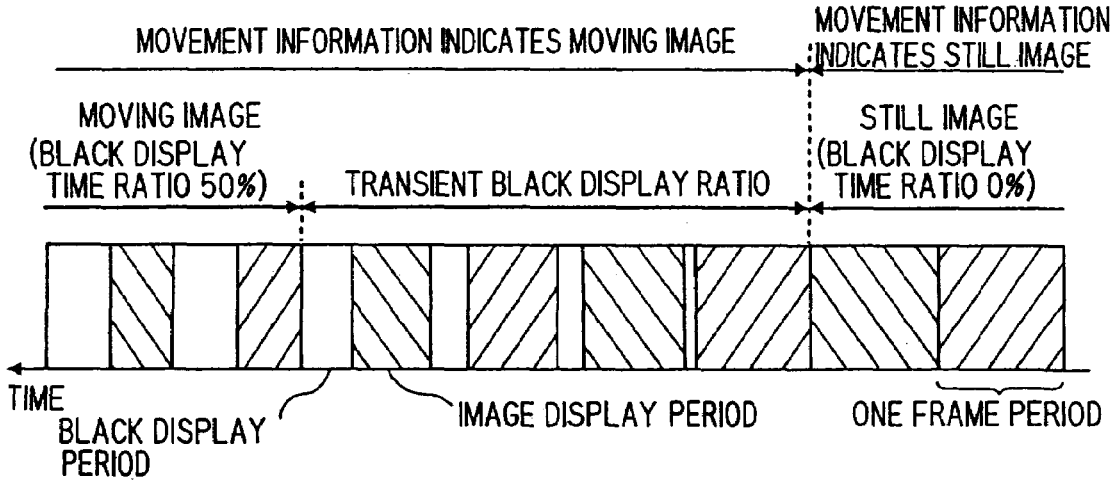
FIG. 3 is a drawing showing the operation in the first embodiment.

In the same manner, when the movement information is changed from the moving image to the still image, the transient black display time ratios are set as shown in FIG. 3, so that the abrupt change in the black display time ratio is restrained.

(3-2) When the Movement Information is Changed in the Transient Black Display Period Subsequently the case in which the movement information is changed in the transient black display period will be described.

Figure 4:
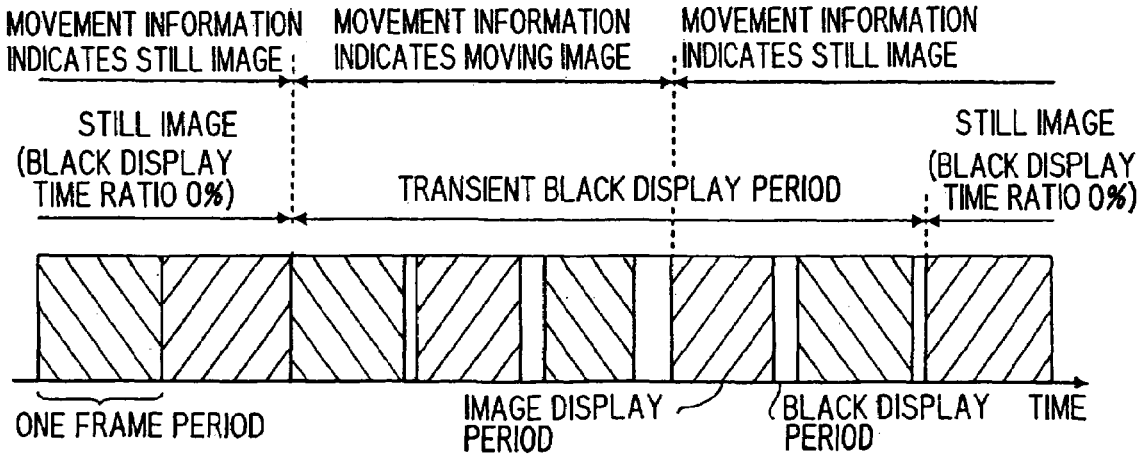
FIG. 4 is a drawing showing the operation in the first embodiment.

FIG. 4 shows a pattern diagram showing a display state in the case in which the movement information is changed in the transient black display period.

In FIG. 4, the movement information is changed from the still image to the moving image at the third frame, and the movement information is changed again from the moving image to the still image at the sixth frame. In this case, as shown in FIG. 4, the transient black display time ratio increases once when the movement information is changed from the still image to the moving image. However, since the movement information is changed again from the moving image to the sill image in the transient black display period, the black display time ratio is decreased. In other words, the black display time ratio Br (N) of the $N^{th}$ frame is formularized as Expression 3.

$$Br(N) = Br(N-1) + TrM(N) \quad \text{[Expression 3]}$$

where;

$$Br(N) = \begin{cases} B_{min} & (Br(N) < B_{min}) \\ B_{max} & (Br(N) > B_{max}) \\ Br(N) & (\text{otherwise}) \end{cases} \quad \text{[Expression 4]}$$

In this Expression, Tr represents the amount of change in transient black display time ratio (10% in this embodiment), M(N) represents the movement information of the Nth frame, $B_{max}$ represents the maximum black display time ratio for the moving image (50% in this embodiment), and $B_{min}$ represents the minimum black display time ratio for the still image (0% in this embodiment). M(N) is formularized as Expression 5.

$$M(N) = \begin{cases} 1 & (\text{movement information indicates moving image}) \\ -1 & (\text{movement information indicates still image}) \end{cases} \quad \text{[Expression 5]}$$

The black display time ratio of the $N^{th}$ frame can be obtained by verifying Expression 3 for every frame.

In Expression 3, the black display time ratio is changed for every frame. However, it is also possible to employ a structure in which the black display time ratio is changed for every plurality of frames. In this case, when the interval of the frames for verification of the black display time ratio is assumed to be ΔN, the black display time ratio is formularized as Expression 6.

$$Br(N)=Br(N-\Delta N)+TrM(N) \quad \text{[Expression 6]}$$

In this arrangement, the black display time ratio is fixed by the display ratio control unit 16, and is inputted to the backlight brightness control unit 20 as the black display time ratio information. The control signals (such as horizontal synchronous signals and vertical synchronous signals) for causing the liquid crystal panel 18 to operate is outputted together with the image signals to be displayed on the liquid crystal panel 18.

(4) Liquid Crystal Panel 18

(4-1) Structure of the Liquid Crystal Panel 18

Figure 5:
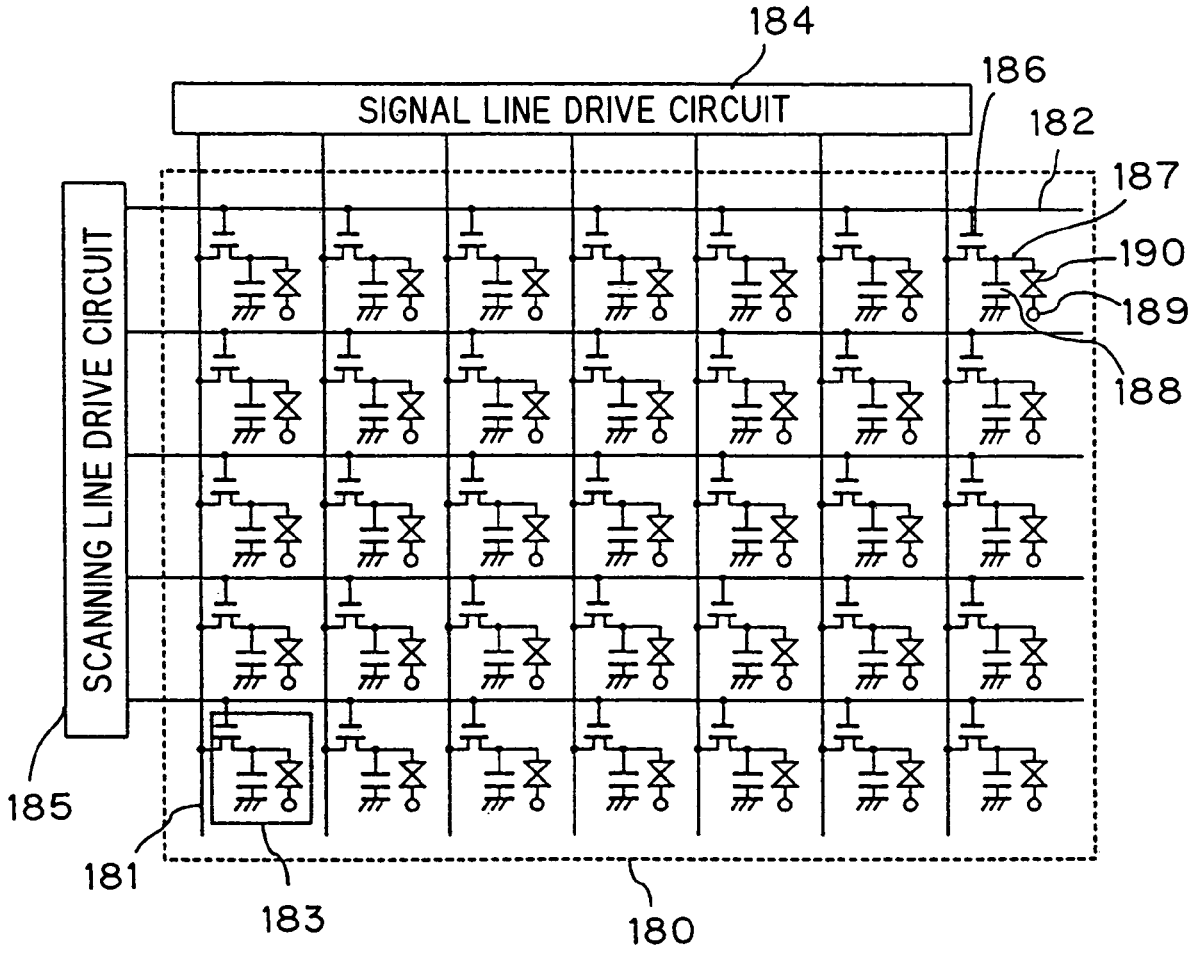
FIG. 5 is a drawing showing a structure of a liquid crystal panel of the first embodiment.

Referring to FIG. 5, the structure of the liquid crystal panel 18 will be described.

The liquid crystal panel 18 is an active matrix type in this embodiment, and as shown in FIG. 5, a plurality of signal lines 181 and a plurality of scanning lines 182 intersecting therewith are arranged in a matrix manner on an array substrate 180 via an insulating layer, not shown, and pixels 183 are formed at the respective intersecting points of both lines 181 and 182. The ends of the signal lines 181 and the scanning lines 182 are connected to a signal line drive circuit 184 and a scanning line drive circuit 185, respectively.

In each pixel 183, a switch element 186 formed of a thin-film transistor (TFT) is the switch element for writing the image signal, and gates thereof are commonly connected to the scanning line 182 by each horizontal line, and sources thereof are commonly connected to the signal line 181 by each vertical line. Each drain is connected to a pixel electrode 187 and is connected to an storage capacitor 188 disposed in electrically parallel with the pixel electrode 187.

The pixel electrode 187 is formed on the array substrate 180, and a common electrode 189 electrically opposing to the pixel electrode 187 is formed on an opposed substrate, not shown. A predetermined common voltage is applied to the common electrode 189 from a common voltage generating circuit, not shown. A liquid crystal layer 190 is held between the pixel electrode 187 and the common electrode 189, and the circumference of the array substrate 180 and the opposed substrate is sealed by a seal material, not shown.

The liquid crystal material used in the liquid crystal layer 190 may be of any type. However, since it is necessary to write two types of image signals such as the image display and the black display in one frame period as described later, the liquid crystal panel 18 is preferably the one which can respond relatively quickly. For example, a ferroelectric liquid crystal or a liquid crystal of an OCB (Optically Compensated Bend) mode is preferable.

The scanning line drive circuit 185 is composed of a shift resistor, a level shifter, a buffer circuit, not shown. The scanning line drive circuit 185 outputs line selection signals to the respective scanning lines 182 based on vertical start signals or vertical clock signals outputted from the display ratio control unit 16 as the control signals.

The signal line drive circuit 184 includes an analogue switch, a shift resistor, a sample hold circuit, a video bus, not shown. The signal line drive circuit 184 is supplied with horizontal start signals and horizontal clock signals outputted from the display ratio control unit 16 as the control signals, and also with the image signals.

(4-2) Operation of the Liquid Crystal Panel 18

Subsequently, the operation of the liquid crystal panel 18 according to this embodiment will be described.

Figure 6:
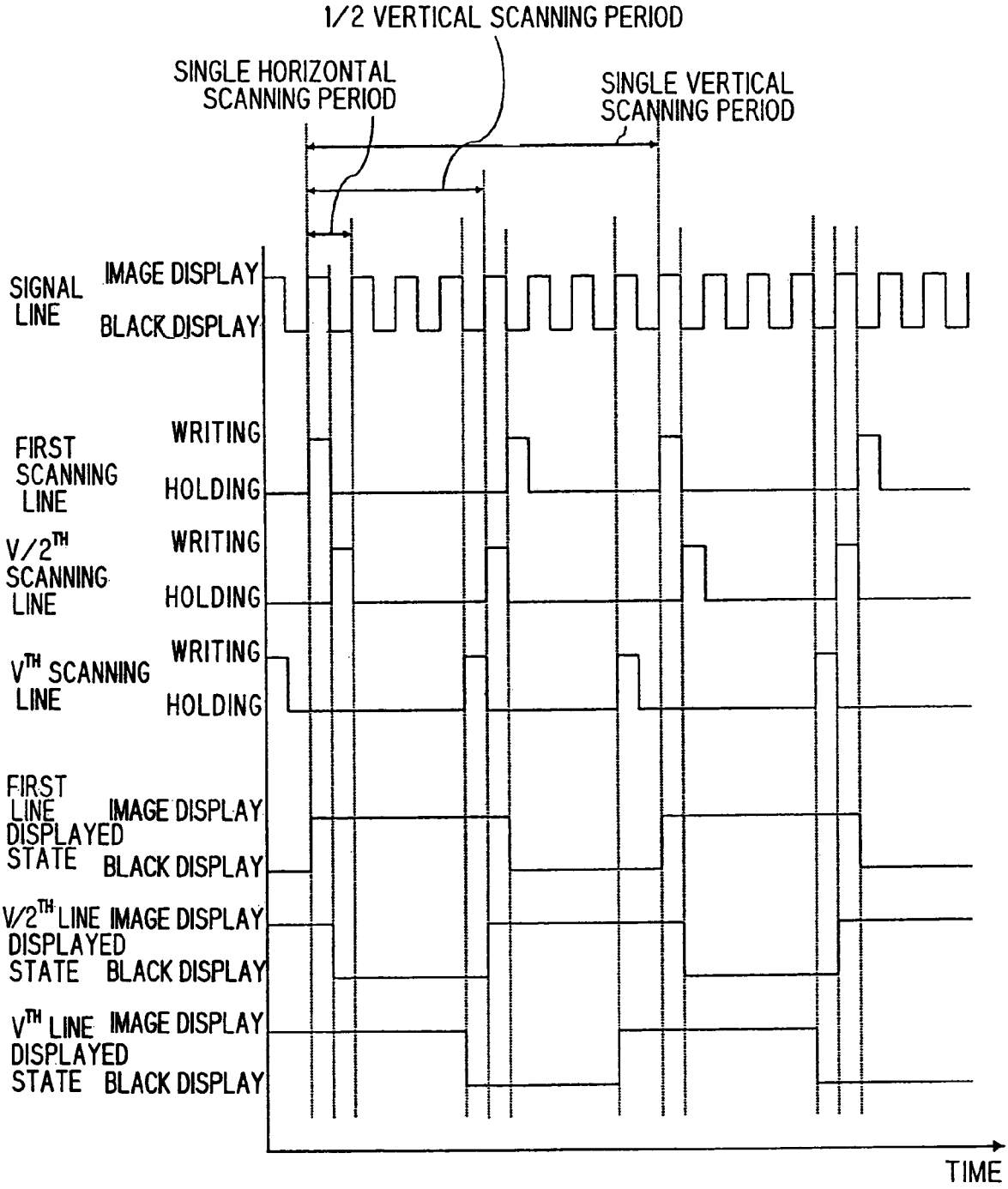
FIG. 6 is a drawing showing an operation in the liquid crystal panel of the first embodiment.

A timing chart of the liquid crystal panel 18 according to this embodiment is shown in FIG. 6. FIG. 6 shows drive waveforms of the display signals outputted from the signal line drive circuit 184 and the scanning signals outputted from the scanning line drive circuit 185, and the state of image display on the liquid crystal panel 18. In FIG. 6, for the simplification of description, blanking periods are not shown. However, the drive signals for the general liquid crystal panel 18 have horizontal and vertical blanking periods.

The signal line drive circuit 184 transmits the image display signals in the former half of a single horizontal scanning period and black display signals in the latter half of the same. The scanning line drive circuit 185 selects the scanning lines 182 corresponding to the respective pixels 183 to which the image display signals are to be supplied in the former half of the single horizontal scanning period, and selects the scanning lines 182 corresponding to the pixels 183 to which the black display signals are to be supplied in the later half of the same.

FIG. 6 is a timing chart of the case in which the black display time ratio is 50%.

When the first scanning line 182 is selected and the image display signal to the corresponding pixel 183 is supplied in the former half of the single horizontal scanning period, the $V/2+1^{th}$ scanning line 182 is selected and the black display signal is supplied to the corresponding pixel 183 in the latter half of the single horizontal scanning period, where V represents the number of the vertical scanning lines.

Likewise, when the second scanning line 182 is selected in the former half of the single horizontal scanning period, the $V/2+2^{th}$ scanning line 182 is selected in the latter half of the single horizontal scanning period.

In the same manner, the subsequent scanning line 182 is selected in the former half of the single horizontal scanning period and the latter half of the same respectively in sequence.

In this manner, when the $V^{th}$ scanning line 182 is selected and the image display signal is supplied to the corresponding pixel 183 in the former half of the single horizontal scanning period, the $V/2^{th}$ scanning line 182 is selected and the black display signal is supplied to the corresponding pixel 183 in the latter half of the single horizontal scanning period.

FIG. 7 shows a display state on the liquid crystal panel 18 in the case in which the black display time ratio is 50%.

Figure 7A:
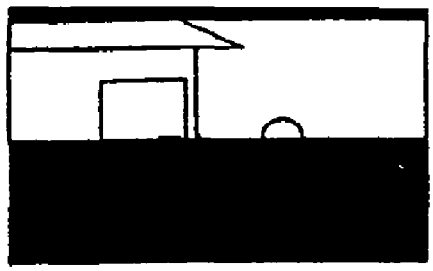
FIG. 7 is a drawing showing a display state on the liquid crystal display device according to the first embodiment.
Figure 7B:
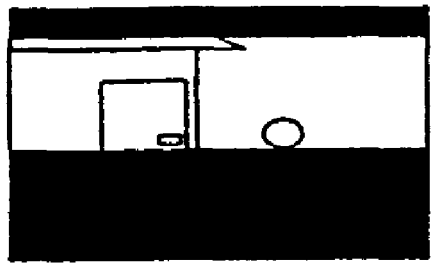
Figure 7C:
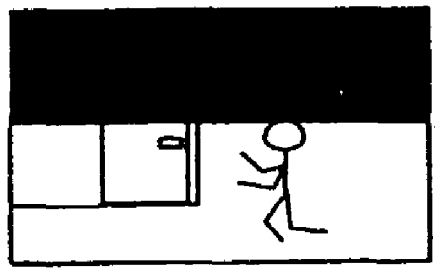
Figure 7D:
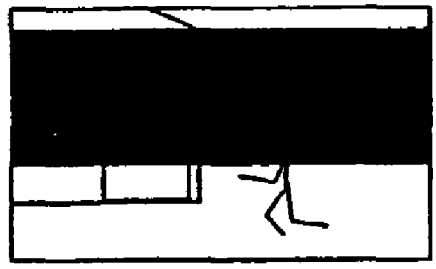
Figure 7E:
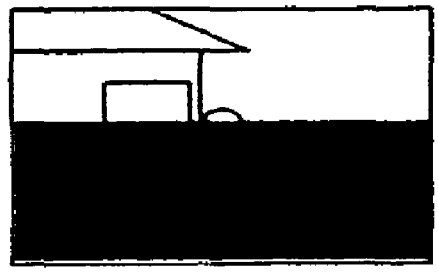

FIG. 7A shows a display state in which writing of the image display signals on the $n^{th}$ frame is completed up to the $V/2+1^{th}$ line, and the black display signals are written on the first line. FIG. 7B shows a display state in which writing of the image display signals on the $n^{th}$ frame is completed up to the $V/2+2^{th}$ line, and the black display signals are written on the second line. FIG. 7C shows a display state in which the image display signals on the $n^{th}$ frame are written on the $V^{th}$ line and the black display signals are written on the $V/2-1^{th}$ line. FIG. 7D shows a state in which the image display signals on the $n+1^{th}$ frame are written on the first line, and the black display signals are written on the $V/2^{th}$ line. FIG. 7E shows a state in which the image display signals on the $n+1^{th}$ frame are written on the $V/2^{th}$ line, and the black display signals are written on the $V^{th}$ line.

Although the case in which the black display time ratio is 50% is shown in FIG. 6, a desired black display period can be set by likewise changing the write-start timing of the black display signals, that is, by changing the timing of the scanning line 182 signals. Therefore, by fixing the black display time ratio by the display ratio control unit 16 and inputting a write-start timing of the black display signal to the liquid crystal panel 18 as the control signal, the image can be displayed on the liquid crystal panel 18 with an arbitrary black display time ratio.

(5) Backlight Brightness Control Unit 20

(5-1) Structure of the Backlight Brightness Control Unit 20

The backlight brightness control unit 20 outputs backlight brightness control signals for controlling a light source of the backlight 22 using the inputted black display time ratio information. In other words, if the light source of the backlight 22 is an analogue modulated LED, the backlight brightness control unit 20 outputs the analogue voltage signals, and if it is a pulse width modulated (PWM) LED, it outputs the pulse width modulated signals. When the light source is a cold cathode tube, it outputs the analogue voltage inputted into an inverter for illuminating the cold cathode tube.

In this embodiment, the LED light source of a pulse width modulated system, which can secure a wide dynamic range of brightness in a relatively simple structure is used. The relation between the pulse width to be inputted into the LED light source and the brightness of the backlight 22 is measured in advance, and is stored in the backlight brightness control unit 20. As data to be stored, for example, it may be a function if the relation can be expressed by the function.

It is also possible to hold it in an ROM as a LUT.

When the LED light source has a structure mixing three LCD colors of red, green and blue to display white color, it is preferable to hold this data on the respective LEDs.

(5-2) Relation Between the Black Display Time Ratio and Relative Brightness

Figure 8:
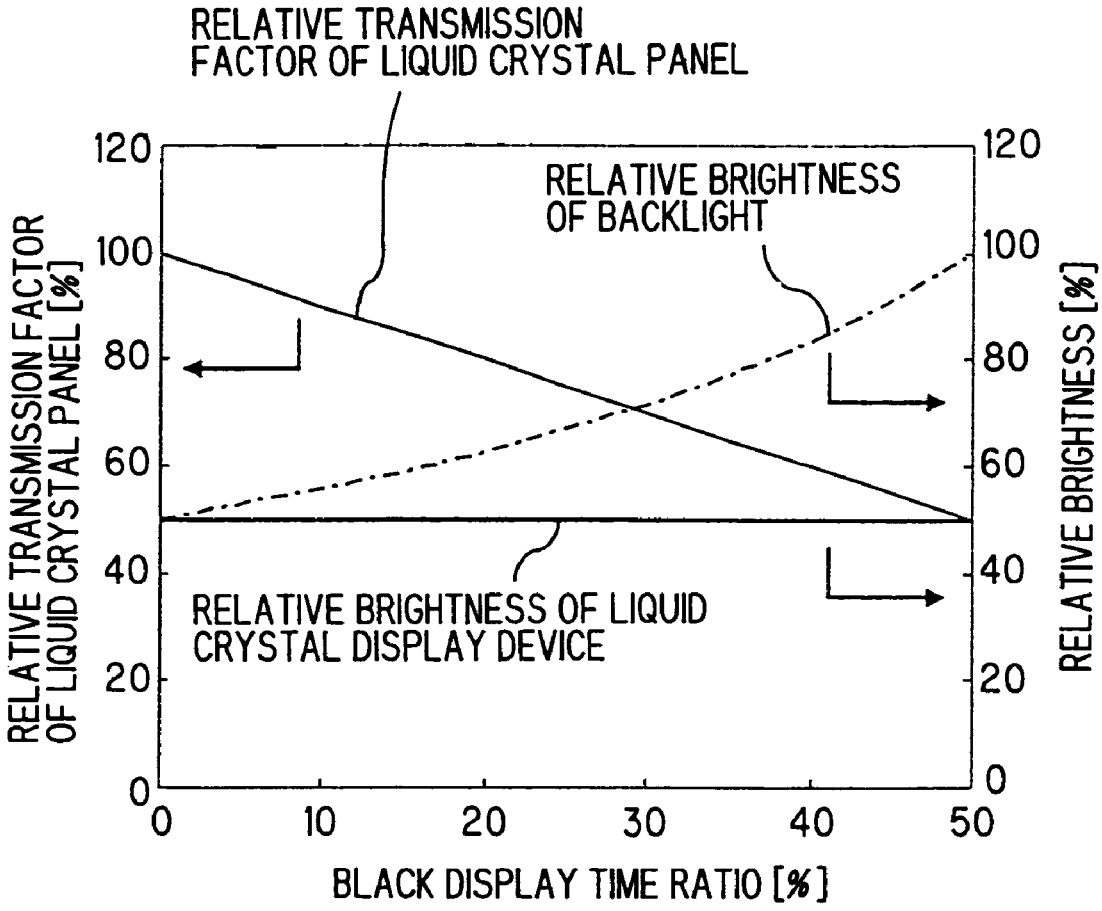
FIG. 8 is a drawing showing a relation of a black display time ratio with respect to a relative coefficient of transmission of the liquid crystal panel, a relative brightness of a backlight, and a relative brightness of the liquid crystal display device according to the first embodiment.

FIG. 8 shows the relation of the black display time ratio to relative transmittance of the liquid crystal panel 18, relative brightness of the backlight 22, and relative brightness of the liquid crystal display device 10, in which the range of black display time ratio is set to 0% to 50%. The horizontal axis represents the black display time ratio, the right vertical axis represents the relative transmittance of the liquid crystal panel 18 with respect to the transmittance when the black display time ratio is 0%, and the left vertical axis represents the relative brightness of the backlight 22 with respect to the brightness when the black display time ratio is 100%.

Since the liquid crystal panel 18 used in this embodiment is such that the transmittance linearly reduces with increase in the black display time ratio, the brightness of the backlight 22 is increased with increase in the black display time ratio, and the brightness of the backlight 22 is controlled so that the relative brightness of the liquid crystal display device 10, that is, the brightness after having passed the liquid crystal panel 18 becomes constant. The relation between the black display time ratio and the relative brightness with respect to the backlight 22 is obtained from FIG. 8, and the relation between the black display time ratio and the pulse width can be obtained from the relation between the relative brightness of the backlight 22 and the pulse width to be inputted to the LED light source, and the backlight brightness control signal represented by the pulse width can be obtained from the black display time ratio information obtained by the display ratio control unit 16.

Although the liquid crystal panel 18 displayed at various black display time ratios is controlled so that the brightness becomes always constant for one frame period, it is also acceptable to control to restrain variations in brightness within a predetermined range centered on a brightness which acts as a benchmark in one frame period. In other words, the object of this embodiment can be achieved as long as it is a control to restrain variation in brightness within a range in which variations in brightness cannot be recognized when viewed by human's eyes.

(5-3) Modification of the Backlight Brightness Control Unit 20

Although the method of storing the relation between the pulse width and the backlight brightness as data has been shown in the description above, it is also possible to store the relation between the black display time ratio and the pulse width at which the brightness on the liquid crystal panel 18 displayed at various black display time ratio becomes constant.

In other words, a white image is displayed on the liquid crystal panel 18 at a certain black display time ratio, the backlight brightness is controlled so that the brightness after having passed the liquid crystal panel 18 becomes a predetermined value, and the pulse width inputted to the LED light source at that time is obtained. The above-described operation is performed at various black display time ratios, and relation between the black display time ratio and the pulse width is obtained, which is stored as data. By referring the data by the inputted black display time ratio information, the brightness of the backlight 22 is controlled, so that the brightness of the liquid crystal panel 18 can be maintained constant with respect to an arbitrary black display time ratio.

In addition to those described above, a method of controlling the brightness of the LED light source by installing a photodiode or the like in the backlight 22 and performing feedback while measuring the brightness of the backlight 22 by the photodiode or the like may be employed. In particular, a structure in which the feedback is performed by the photodiode or the like as described above is effective since the light-emitting characteristics of the LED light source are varied depending on the temperature.

(6) Backlight 22

The backlight 22 can be configured with various light sources as described above, and in this embodiment, the direct backlight 22 with the LED as the light source is employed.

However, the structure of the backlight 22 is not limited to those described above, and the edge-lighting backlight 22 using an optical waveguide may also be applicable. The backlight 22 is controlled in brightness by the backlight brightness control signals outputted from the backlight brightness control unit 20.

(7) Effects of the Liquid Crystal Display Device 10

Subsequently, the effect of the liquid crystal display device 10 in this embodiment will be described.

The liquid crystal display device 10 determines whether the input image is the moving image or the still image so as to improve sharpness of the moving image by increasing the black display time ratio for the moving image, and reduce the brightness of the backlight 22 by reducing the black display time ratio to reduce the power consumption for the still image. Simultaneously, the liquid crystal display device 10 can restrain flicker from occurring by employing a quasi-impulse display for the still image.

Flicker which occurs due to abrupt change of the black display time ratio can be restrained as much as possible by setting the transient black display period. The principle of occurrence of flicker due to the abrupt change of the black display time ratio will now be described.

Figure 9:
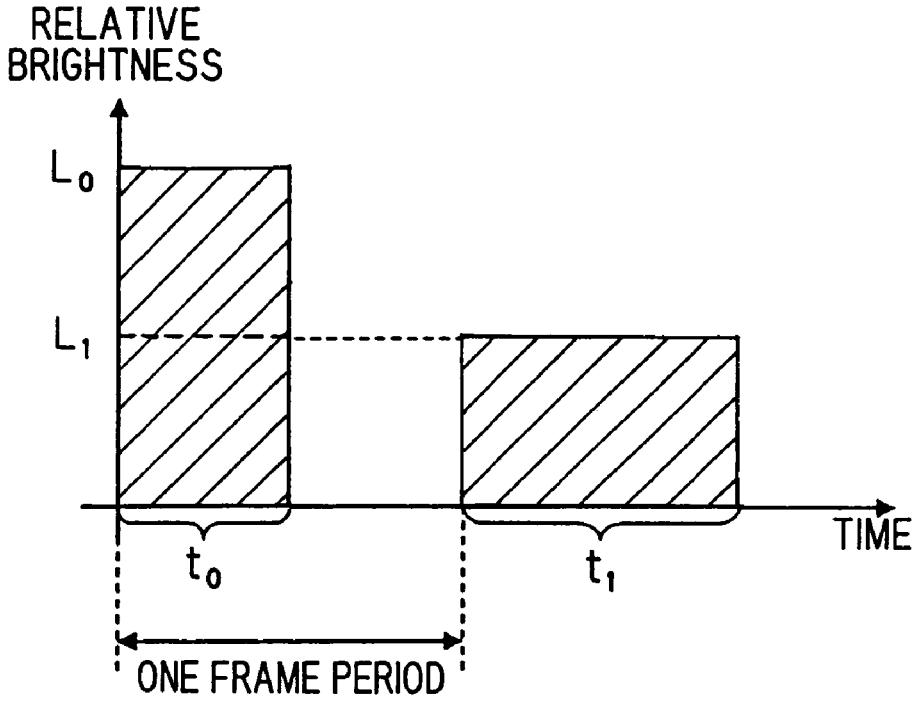
FIG. 9 is an explanatory drawing showing an effect of the first embodiment.

FIG. 9 shows a pattern diagram showing the change in display brightness when the image display time ratio (=1−black display time ratio) is changed from $t_0$ to $t_1$ ($t_0<t_1$). Assuming that $L_0$ represents relative display brightness in the period of $t_0$, and $L_1$ represents relative display brightness in the period of $t_1$, the average brightness in one frame period is constant irrespective of the image display ratio, and hence Expression 7 is satisfied.

$$t_0L_0=t_1L_1=L_{ave} \quad \text{[Expression 7]}$$

Subsequently, relative integral brightness in an arbitrary one frame period when the image display ratio is changed from $t_0$ to $t_1$ will be considered. The human eyes can perceive brightness by integrating stimulation that his/her retinas receives in a certain constant period. Therefore, perceivable brightness is modeled by integrating the brightness of the liquid crystal display device 10 in one frame period. The value of the integral brightness to be controlled at a constant value can be defined by using the relative integral brightness when the black insertion control is not performed, or the integral brightness obtained by illuminating the backlight 22 at the maximum luminous brightness and displaying the image with the maximum black insertion rate within the controllable range. Not only such integral brightness, but also integral brightness obtained when the backlight 22 emits light at a certain specified luminous brightness and the image is displayed with a certain specified black insertion rate may be employed.

Figure 10:
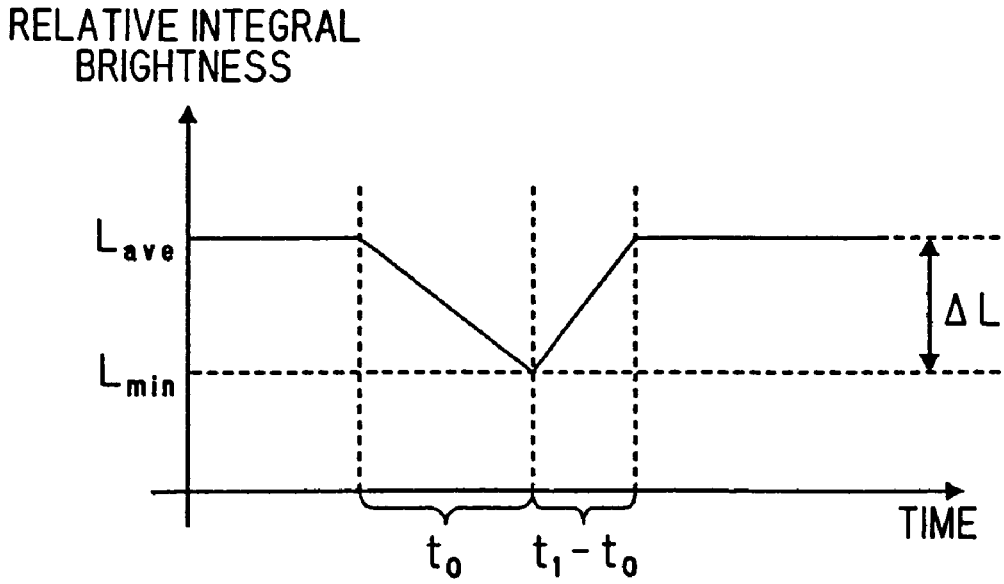
FIG. 10 is an explanatory drawing showing the effect of the first embodiment.

FIG. 10 shows temporal variation in relative integral brightness in an arbitrary one frame period when the image display ratio is changed from $t_0$ to $t_1$. The horizontal axis represents time, and the vertical axis represents relative integral brightness. When the image display time ratio is a constant value of $t_0$ or $t_1$, the relative integral brightness in the arbitrary one frame period becomes a constant value $L_{ave}$. However, at a timing where the image display ratio changes from $t_0$ to $t_1$, part of the relative brightness $L_0$ when the image display ratio is to and part of the relative brightness $L_1$ at the time when the image display period ratio is $t_1$ are integrated in an arbitrary one frame period, and hence the relative integral brightness is changed to a smaller value as shown in FIG. 10. Assuming that the smallest value at this time is $L_{min}$, $L_{min}$ can be formularized as Expression 8 using Expression 7.

$$L_{min} = t_0L_1 = \frac{t_0}{t_1}L_{ave} \quad \text{[Expression 8]}$$

Therefore, the amount of change ΔL of the relative integral brightness is formularized as Expression 9.

$$\Delta L = L_{ave} - L_{min} = \left(1 - \frac{t_0}{t_1}\right)L_{ave} \quad \text{[Expression 9]}$$

The period Δt in which the relative integral brightness is smaller than $L_{ave}$ is formularized as Expression 10 from FIG. 10.

$$\Delta t=t_0+(t_1-t_0)=t_1 \quad \text{[Expression 10]}$$

Since perceivable flicker is considered to be proportional to a product of the strength (ΔL) of flicker and the period of generation (Δt) of flicker, perceivable flicker I is formularized as Expression 11.

$$I=\alpha\Delta t\Delta L=\alpha(t_1-t_0)L_{ave}=\alpha|t_1-t_0|L_{ave} \quad \text{[Expression 11]}$$

Here, α represents a proportional constant.

Figure 11:
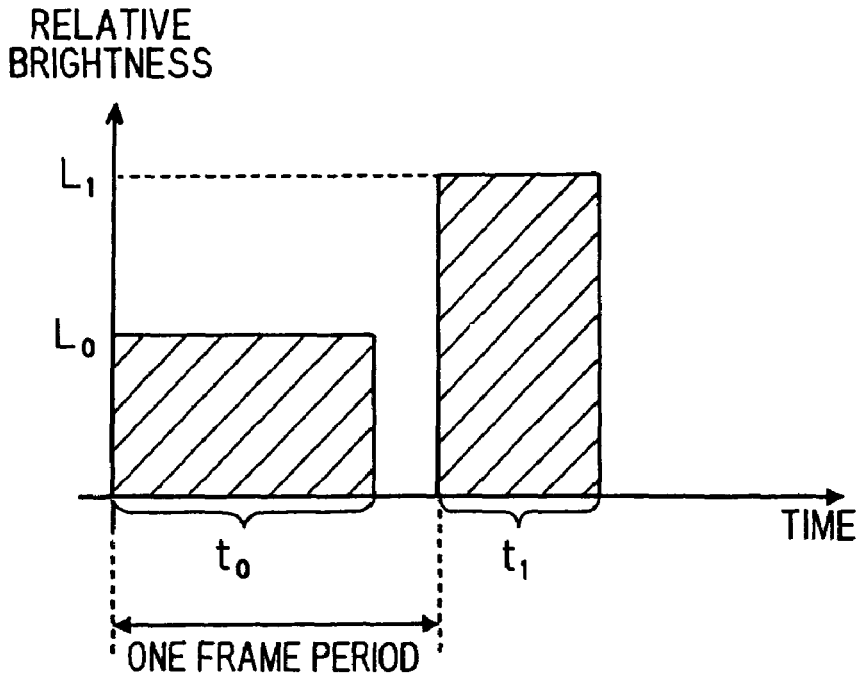
FIG. 11 is an explanatory drawing showing the effect of the first embodiment.
Figure 12:
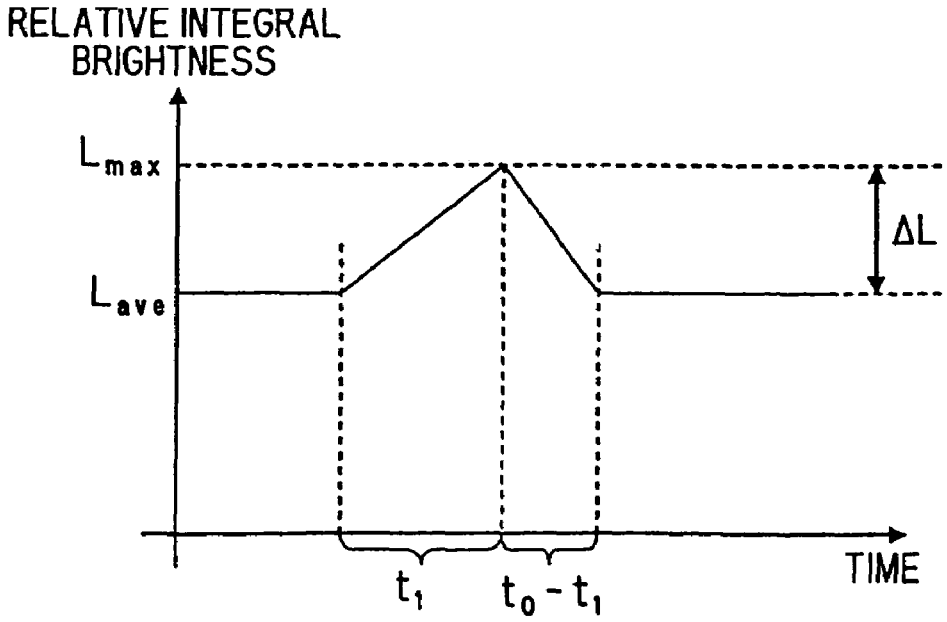
FIG. 12 is an explanatory drawing showing the effect of the first embodiment.

On the other hand, as shown also in FIG. 11, when a case in which the image display ratio is changed from $t_0$ to $t_1$ ($t_0>t_1$) is considered in the same manner, the relative integral brightness of an arbitrary one frame period will be as shown in FIG. 12. In other words, at a timing where the image display time ratio is changed from $t_0$ to $t_1$, part of the relative brightness $L_0$ when the image display ratio is to and part of the relative brightness $L_1$ at the time when the image display period ratio is $t_1$ are integrated in an arbitrary one frame period, and hence the relative integral brightness is changed to a larger value as shown in FIG. 12. Assuming that the maximum value at this time is $L_{max}$, $L_{max}$ can be formularized as Expression 12 using Expression 7.

$$L_{max} = t_1L_1 - (t_0 - t_1)L_0 = \left(1 + \frac{t_0 - t_1}{t_0}\right)L_{ave} \quad \text{[Expression 12]}$$

Therefore, the amount of change ΔL of the relative integral brightness is shown as Expression 13.

$$\Delta L = L_{max} - L_{ave} = \left(1 - \frac{t_1}{t_0}\right)L_{ave} \quad \text{[Expression 13]}$$

The period ΔT in which the relative integral brightness is larger than $L_{ave}$ is formularized as Expression 14 from FIG. 12.

$$\Delta t = t_1 + (t_0 - t_1) = t_0 \quad \text{[Expression 14]}$$

Therefore, the perceivable flicker I is formularized as Expression 15.

$$I = \alpha \Delta t \Delta L = (t_0 - t_1) L_{ave} = \alpha |t_1 - t_0| L_{ave} \quad \text{[Expression 15]}$$

As described above, the perceivable flicker when the image display ratio is changed from $t_0$ to $t_1$ is proportional to the amount of change in image display ratio, that is, the amount of change in black display time ratio from Expression 11 and Expression 15. Therefore, by setting the transient black display period according to the amount of change in black display time ratio so that the perceivable flicker is less than cognitive limit to be perceived, occurrence of flicker due to the abrupt change of the black display period ratio can be restrained.

As described above, according to the liquid crystal display device 10 in this embodiment, by changing the black display time ratio depending on whether the input image is the moving image or still image, improvement of the image quality of the displayed input image can be achieved while controlling increase in power consumption. In addition, flicker occurred by the abrupt change in the black display time ratio can be restrained as much as possible.

Second Embodiment

Figure 13:
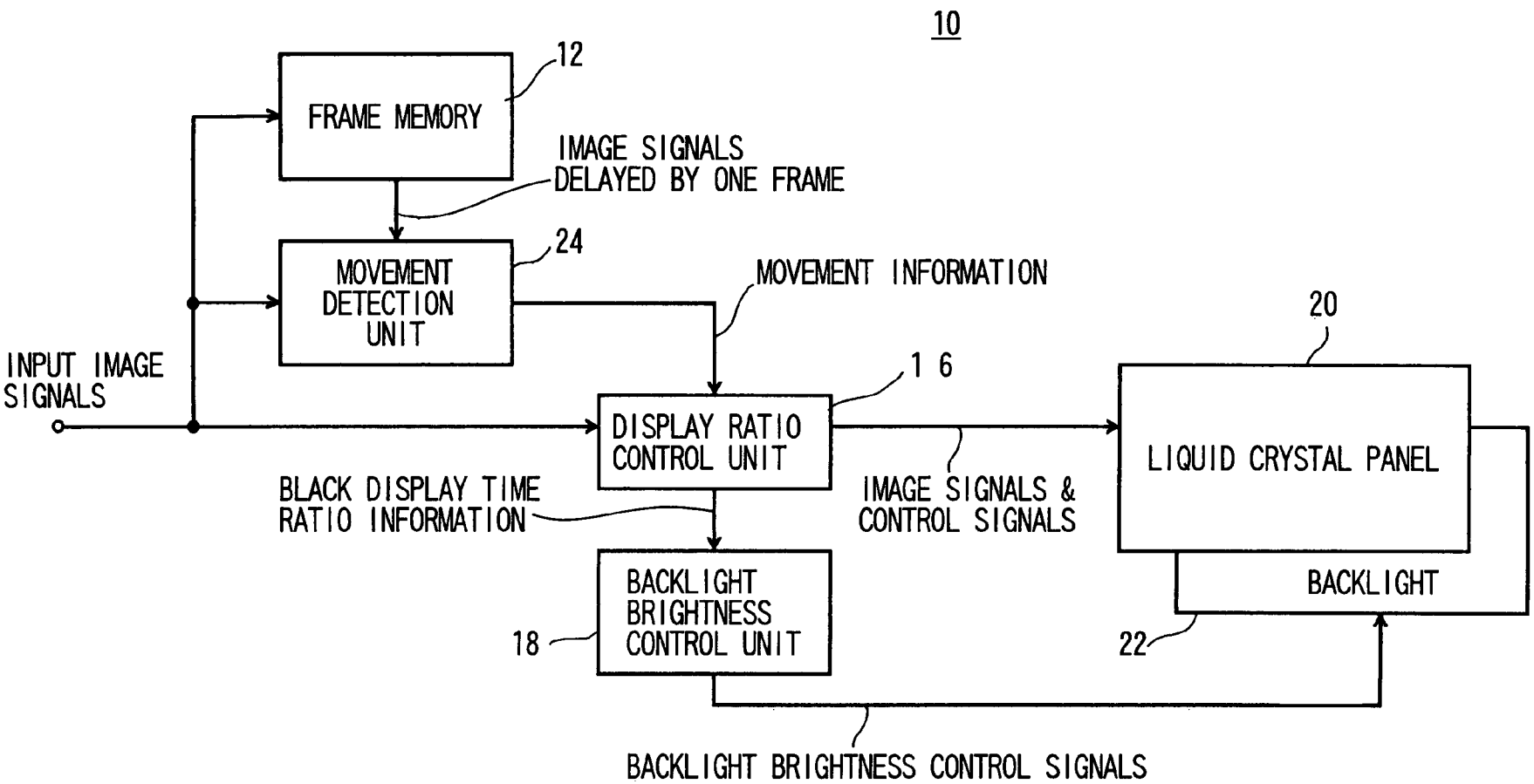
FIG. 13 is a drawing showing a structure of the liquid crystal display device according to a second embodiment.
Figure 14:
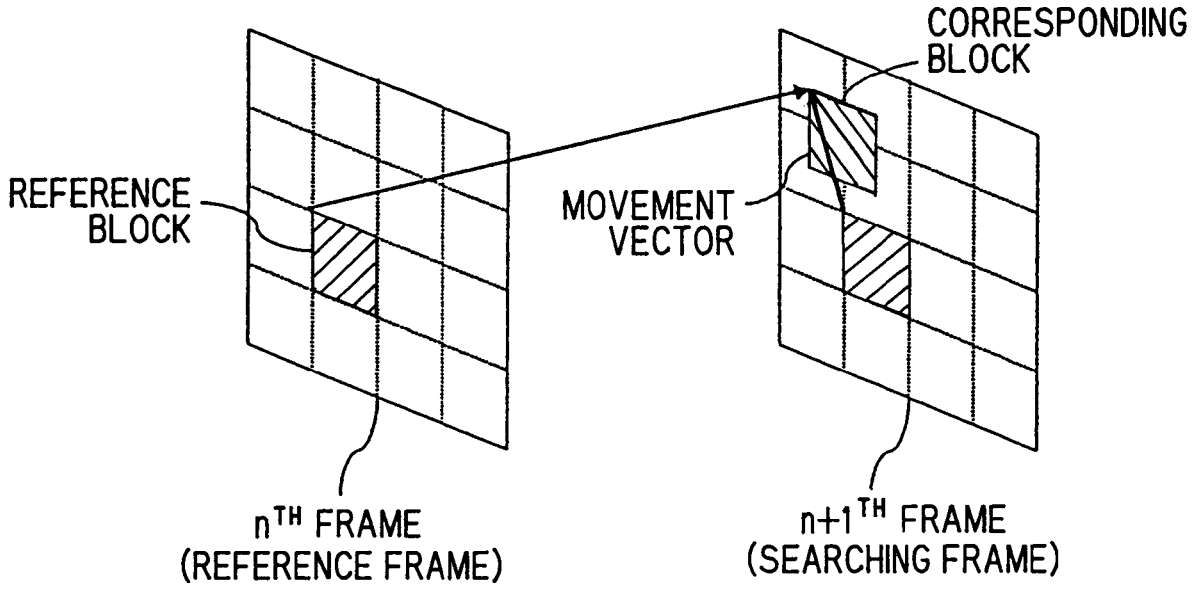
FIG. 14 is a pattern diagram showing a method of detecting vector of a movement according to the second embodiment.

Referring to FIG. 13 and FIG. 14, the liquid crystal device 10 according to a second embodiment of the invention will be described.

(1) Structure of Liquid Crystal Display Device 10

FIG. 13 shows a structure of the liquid crystal display device 10 according to the second embodiment of the invention.

Although the basic structure of the liquid crystal display device 10 according to the second embodiment is the same as the first embodiment, the second embodiment is characterized in that movement information which is more detailed than the moving image/still images is detected from the input image by a movement detection unit 24, and the black display time ratio which is divided into smaller sections is controlled.

(2) Movement Detection Unit 24

(2-1) Structure of the Movement Detection Unit 24

The movement detection unit 24 detects the movement by using a plurality of frames of the input image signals, and outputs the same as movement information. In this embodiment, the input image signals are stored by the frame memory 12 during the time of one frame period, and the movement is detected by comparison of the image signals delayed by one frame and the input image signals, that is, temporally adjacent two frames. However, the frames used for detecting the movement are not limited to the temporally adjacent two frames, and the movement detection may be achieved by using only frames of even number or frames of odd number when the input image signals are the interlaced image signals.

Although various movements detecting means may be considered, a method of obtaining movement vector by block matching is employed in this embodiment. The block matching is a method of detecting movement vector used for coding of the moving image such as Moving Picture Experts group (MPEG) and, as shown in FIG. 14, $n^{th}$ frame of the input image signals (reference frame) is divided into square areas (blocks) Here the similar areas are searched in the $n+1^{th}$ frame (frame to be searched) for each block. Although the method of verification of the similar areas may generally be Summation of Absolute Differences (SAD) or Summation of Squared Differences (SSD), in this embodiment, it is obtained by Expression 16 using the SAD.

$$SAD(d) = \sum_{x \in B} |p(x, n) - p(x + d, n + 1)| \quad \text{[Expression 16]}$$

Here, the term p (x,n) represents the pixel value of a position x of the $n^{th}$ frame, and B represents the range of the reference block. The SAD is obtained using Expression 16 for various d, and the d in which the SAD is the minimum, is estimated to be a movement vector of the reference block B. This is formularized as Expression 17.

$$MV = \underset{d}{\operatorname{argmin}} SAD(d) \quad \text{[Expression 17]}$$

By solving Expression 16 and Expression 17 for all the blocks in the reference frame, the movement vector between the adjacent frames of the input image signals can be obtained.

(2-2) Method of Obtaining Movement Information

Subsequently, a method of obtaining the movement information from the detected movement vector will be described.

The liquid crystal display device 10 of this embodiment controls the display ratio of the black display period in one frame period based on the movement information of the input image signals. In other words, if it is the still image, the black display for improving the image quality of the moving image is not necessary, and hence the black display time ratio may be zero. On the other hand, when the input image includes the movement, it is necessary to determine the black display time ratio according to the movement. However, in this case, the black display time ratio is determined based on deterioration of the image quality due to a hold effect that the observer views in the input image. In other words, when deterioration of the image quality caused by the hold effect due to the movement contained in the input image is significant, the black display time ratio is increased. In contrast, when deterioration of the image quality caused by the hold effect due to the movement contained in the input image is small, the black display time ratio is decreased.

Although various types of the movement information which significantly affect the image quality deterioration caused by the hold effect, that is, the movement information significant for fixing the black display time ratio are considered, in this embodiment, the following information will be included.

1) speed of movement 2) directionality of movement 3) contrast of a moving object 4) spatial frequency of the moving object The "speed of movement" means the speed of the moving object included in the input image. The higher the speed of movement, the larger the black display time ratio is set to be, while the lower the speed of movement, the smaller the black display time ratio is set to be. When the speed of movement is zero, it is the still image. This is because the shift amount superimposed on the retinas when the observer's eyes follow the moving object increases with increase in speed of the movement, and hence deterioration of the image quality caused by the hold effect increases.

The "directionality of movement" means how the directions of movement contained in the input image are dispersed. Since deterioration of the image quality caused by the hold effect is deterioration which occurs when the observer's eyes follow the moving object, when the directions of movement contained in the input image are all the same and uniform, deterioration of the image quality caused by the hold effect becomes great, and in contrast, when the directions of movement contained in the input image are varied, the observer's eyes have difficulty following each moving object, and hence deterioration of the image quality caused by the hold effect is reduced. Therefore, the smaller the dispersion of the directionality of movement, the larger the black display time ratio is set to be, and the larger the dispersion of directionality of movement, the smaller the black display time ratio is set to be.

The "contrast of moving object" is difference in gray-scale level between the still image background and the moving object. Deterioration of the image quality caused by the hold effect is seen as bluring, and the smaller the gray-scale level difference between the still image background and the moving object, the less bluring is seen at the borderline between the still image background and the moving object. As an extreme example, when the gray-scale level difference between the still image background and the moving object is zero, bluring is not seen. Therefore, the larger the contrast of the moving object, the larger the black display time ratio is set to be, while the smaller the contrast of the moving object, the smaller the black display time ratio is set to be.

The "spatial frequency of the moving object" represents fineness of the texture of the moving object. Deterioration of the image quality caused by the hold effect is recognized by the observer as bluring, and the bluring occurs at the edge of the moving object. For example, even when the moving object of a single color moves, inside the moving object, bluring is not seen, since an edge does not exist. On the other hand, when there is a texture (for example, stripes) inside the moving object, bluring of the texture inside the moving object is recognized by the observer. Therefore, the higher the spatial frequency of the moving object, the larger the black display time ratio is set to be, while the lower the spatial frequency of the moving object, the smaller the black display time ratio is set to be. The above-described movement information is simply an example, and hence, only one part of the above-described four types of movement information need be employed as the movement information, or other types of information may be added as the movement information.

(2-3) Method of Obtaining from the Input Image

Subsequently, a method of obtaining the above-described respective information from the input image as a parameter of the movement information will be described. In this embodiment, the difference between the adjacent frames is obtained before detecting the movement and calculating the movement information, and rough determination whether the image is a still image or a moving image is based on the inter-frame absolute difference value. In other words, a threshold calculation is performed for the inter-frame absolute difference value, and when the calculated value is smaller than the threshold value, it is determined to be the still image, and hence detection of the movement or calculation of the movement information is not performed and the movement information is outputted as the still image. On the other hand, when it is the threshold value or higher, movement detection and calculation of the movement information as described above are performed, and the four parameters are outputted as the movement information.

(2-3-1) Speed of Movement

1) Estimate the movement vector for each frame according to the method described above to find the movement vectors having scalar magnitude of 1 or higher.

2) Classify the above-described movement vectors into into eight directional ranges of movement of 45° each, and obtain the numbers of movement vectors in each movement range.

3) Arrange the numbers of the movement vectors for the respective movement ranges obtained in 2) in a descending order to find the ratios of the numbers of the movement vectors in each movement range with respect to the number of the movement vectors having scalar magnitude of 1 or higher obtained in 1), and obtain the respective ranges of movement vectors until the cumulative ratio reaches at least 90% of the total.

4) Exclude the ranges of the movement vector obtained in 3) with vector number ratio less than 5% with respect to the number of the movement vectors having scalar magnitude of 1 or higher obtained in 1) above.

5) After having obtained the scalar averages of the movement vectors for the respective movement vector ranges obtained in 4), perform weight-averaging by the respective ratios of the movement ranges obtained in 3) to find the speed of movement.

(2-3-2) Directionality of Movement

The number of ranges of the movement vectors obtained in the speed of movement calculations 1) to 4) described above is set as the directionality of movement.

(2-3-3) Contrast of Moving Object

1) Obtain the absolute difference value in pixel value between the adjacent frames.

2) Set the pixels 183 having the absolute difference value of 10 or higher to be the moving range, and obtain the summation of the absolute difference values in the moving range.

3) Determine a value obtained by dividing the above summation of the absolute difference values by the number of pixels of the moving range where the absolute difference value is 10 or more as a contrast of the moving object.

(2-3-4) Spatial Frequency of the Moving Object

1) Detect the edge direction of the frame image.

2) Estimate the movement vector of the frame image to find the movement vector having scalar magnitude of 1 or higher.

3) Obtain inner product of the edge direction obtained in 1) and the magnitude of the movement vector obtained in 2), set this to be 1, and determine the summation thereof as the spatial frequency of the moving object.

The four parameters obtained via the above-described methods are outputted to the display ratio control unit 16 as the movement information (2-4) Modification of the Movement Information The movement information is not limited to the above-described four parameters, and other parameters may be added.

Alternatively, part of the four parameters described above may be employed.

Furthermore, the methods of obtaining the four parameters described above are not limited to those described above, and other methods may be employed. For example, the concrete values shown in the above-described methods may be other values. The movement information is preferably fixed from the amount of processing and accuracy.

(3) Display Ratio Control Unit 16

(3-1) Function of the Display Ratio Control Unit 16

In the display ratio control unit1 16, the black display time ratio between the display frames in one frame period is obtained based on the inputted movement information. In this embodiment, the black display time ratio is calculated via Expression 18 using the linear summation of the four types of movement information obtained by the movement detection unit 24.

$$Br(N)=a\times spd+b\times dir+c\times cr+d\times freq+e \quad \text{[Expression 18]}$$

where: Br(N) represents the black display time ratio (%) of the $N^{th}$ frame, spd represents the speed of movement, dir represents the directionality of the movement, cr represents the contrast of the moving object, freq represents the spatial frequency of the moving object, and a, b, c, d and e are weighted coefficients.

When the movement information indicates that the image is a still image, calculation of Expression 18 is not performed, and the minimum preset black display time ratio is used. For example, when the preset black display time ratio is from 0% to 50%, and when the movement information indicates that the image is a still image, the black display time ratio is 0%. Subsequently, the respective weighted coefficients in this embodiment are assumed to be a=3, b=−0.4, c=0.06, d=0.001, and e=0.4 from the result of the subjectivity verification experiment.

Although the black display time ratio can be obtained from Expression 18, in order to restrain the abrupt change in the black display time ratio as in the first embodiment, the black display time ratio is further corrected. The black display time ratio is corrected by Expression 19.

$$Br(N) = \begin{cases} Br(N-1) + TrSgn(Br(N) - Br(N-1)) & (|Br(N) - Br(N-1)| > Tr) \\ Br(N) & \text{(otherwise)} \end{cases} \quad \text{[Expression 19]}$$

where:

$$Br(N) = \begin{cases} B_{min} & (Br(N) < B_{min}) \\ B_{max} & (Br(N) > B_{max}) \\ Br(N) & \text{(otherwise)} \end{cases} \quad \text{[Expression 20]}$$

where: Tr represents the amount of change of the transient black display time ratio, Sgn (a) is a function for reversing the sign of a. $B_{min}$ represents the minimum value of the preset range of the black display time ratio, and $B_{max}$ represents the maximum value in the preset range of the black display time ratio. It is also possible to employ a structure in which the black display time ratio is changed for every nth frame as in ths first embodiment. In this case, when the interval between frames whose black display time ratio is evaluated is assumed to be ΔN, the black display time ratio is formularized as Expression 21.

$$Br(N) = \quad \text{[Expression 21]}$$

-continued $$\begin{cases} Br(N-\Delta N) + TrSgn(Br(N) - Br(N-\Delta N)) & (|Br(N) - Br(N-\Delta N) > Tr|) \\ Br(N) & \text{(otherwise)} \end{cases}$$

In order to make the movement more robust with respect to the detected result of the movement information of the movement detection unit 24, median value processing may be performed with respect to the black display time ratio as in the first embodiment. In other words, the black display time ratio before correction of several frames in the past is stored and the median of the black display time ratio of the several frames in the past before correction is employed as the black display time ratio of the current frame before correction, whereby the black display time ratio is corrected using Expression 19 or Expression 21.

The black display time ratio obtained by Expression 19 or Expression 21 is outputted to the backlight brightness control unit 20 as the black display time ratio information. The image signal and the control signal according to the black display time ratio are outputted to the liquid crystal panel 18.

Other structures and operations are the same as those in the first embodiment.

As described above, according to the liquid crystal display device 10 in this embodiment, the black display time ratio is changed depending on whether the input image is the moving image or the still image, and hence improvement of the quality of the displayed input image is achieved while controlling increase in power consumption. In addition, flicker occurred by the abrupt change in the black display time ratio can be restrained as much as possible.

Third Embodiment

Figure 15:
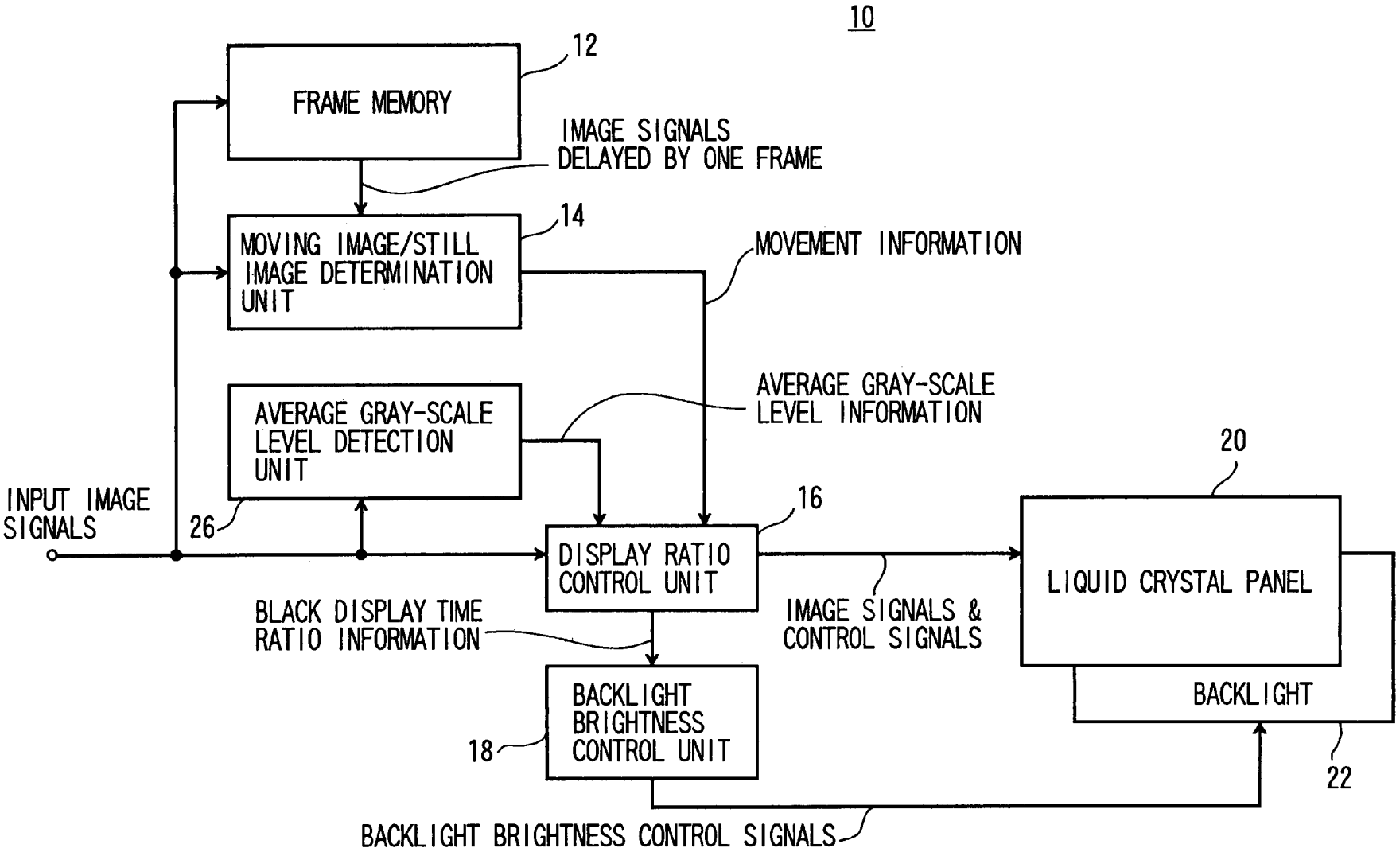
FIG. 15 is a drawing showing a structure of the liquid crystal display device according to a third embodiment.

Referring now to FIG. 15, the liquid crystal display device 10 according to a third embodiment will be described.

(1) Structure of the Liquid Crystal Display Device 10

FIG. 15 shows a structure of the liquid crystal display device 10 according to the third embodiment of the invention.

Although the basic structure of the liquid crystal display device 10 according to the third embodiment is the same as the first embodiment, the third embodiment is characterized in that the average gray-scale level of the input image is calculated to control the amount of change in the transient black display time ratio using the detected result.

(2) An Average Gray-scale Level Detection Unit 26

The average gray-scale level detection unit 26 detects the average gray-scale level of the input image. Assuming that X represents the number of pixels in the horizontal direction and Y represents the number of pixels in the vertical direction in the $N^{th}$ frame, the average gray-scale level $G_{ave}$ can be obtained by Expression 22.

$$G_{ave} = \frac{1}{X\times Y}\sum_{u=1}^{X}\sum_{v=1}^{T} f(u, v, N) \quad \text{[Expression 22]}$$

where: f (u,v,n) represents the pixel value Y component at the position (u,v) of the $n^{th}$ frame. The term f(u,v,n) can be formularized as Expression 2 as a linear summation of the pixel values (gray-scale level) of red, green and blue.

Although the average gray-scale level is obtained for the entire frame in this embodiment, it is also possible to employ a procedure obtaining first a histogram of the input image, and then the average value of the n pixels with the highest gray-scale levels, n being a predetermined fraction of the whole.

(3) Display Ratio Control Unit 16

The display ratio control unit 16 fixes the black display time ratio as in the first embodiment. However, the amount of change Tr in transient black display time ratio is given as a function of the $G_{ave}$. In other words, Expression 3 can be replaced by Expression 23.

$$Br(N)=Br(N-1)+Tr(G_{ave})M(N) \quad \text{[Expression 23]}$$

where: $Tr(G_{ave})$ represents monotone decreasing function relating to $G_{ave}$. In other words, the larger the average gray-scale level of the input image, the smaller the amount of change in the transient black display time ratio becomes. In the same manner, when the structure in the second embodiment is employed as the basic structure, Expression 19 is replaced by Expression 24.

$$Br(N)=\begin{cases} Br(N-1)+ Tr(G_{ave})Sgn(Br(N)-Br(N-1)) & (|Br(N)-Br(N-1)|>Tr(G_{ave})) \\ Br(N) & \text{(otherwise)} \end{cases} \quad \text{[Expression 24]}$$

(4) Effect of the Liquid Crystal Display Device 10

Subsequently, the effect of the liquid crystal display device 10 in this embodiment will be described.

It is generally known that sensitivity of the human's eye increases with reduction of brightness. Brightness sensed by the human is defined as a lightness value (L*), which is known to be substantially proportional to the brightness to the ⅓ power.

$$L^*=\beta Y^{1/3} \quad \text{[Expression 25]}$$

where: β represents a proportional constant and Y represents brightness. From Expression 25, the change of L* with respect to the change of the brightness Y, that is, the sensitivity is formularized as Expression 26.

$$\frac{dL^*}{dY}=\frac{Y^{-2/3}}{3} \quad \text{[Expression 26]}$$

As is clear from Expression 26, the change of the sensitivity is smaller than the change of the brightness Y. For example, when the brightness Y is changed into a half from 1 to 0.5, the sensitivity only changes from about 0.333 to about 0.529, which is about 1.587 times, that is, the smaller the brightness becomes, the change of the sensitivity with respect to the change of the brightness decreases. As is clear from Expression 11 and Expression 15, the perceivable flicker is proportional to $L_{ave}$, that is, to the brightness of the image to be displayed. Therefore, the smaller the brightness of the image becomes, the less the possibility of the flicker being perceived becomes even when the amount of change of the black display time ratio is increased. Even by intuition, when the image is black, the flicker is not perceived irrespective of the change of the black display time ratio.

Other structures and operations are the same as those in the first embodiment.

As described above, according to the liquid crystal display device 10 in this embodiment, by changing the black display time ratio depending on whether the input image is moving image or the still image, improvement of the quality of the displayed input image is achieved while controlling the increase in power consumption. In addition, the flicker which occurs due to the abrupt change of the black display time ratio can be restrained as much as possible.

Fourth Embodiment

Figure 16:
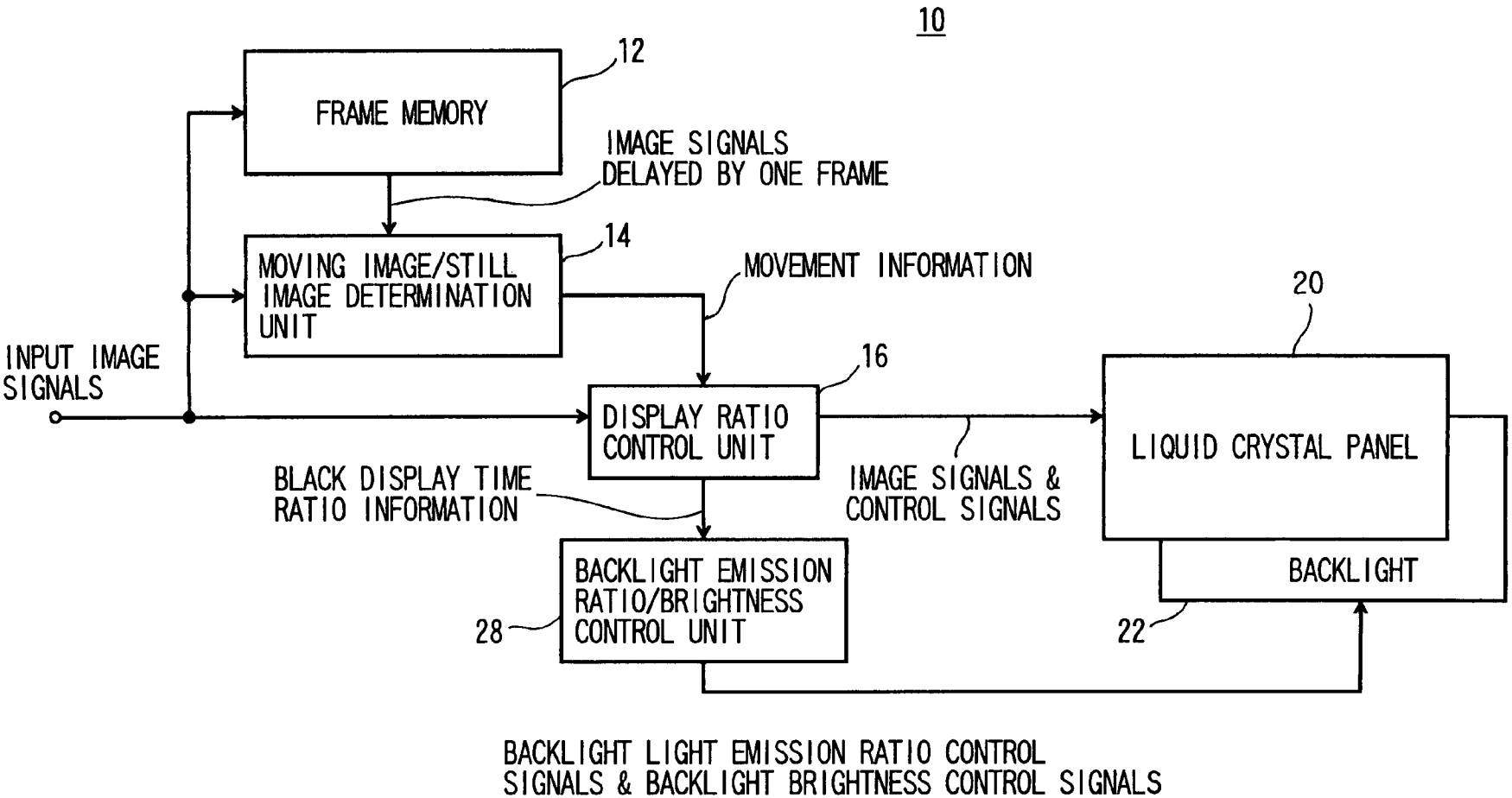
FIG. 16 is a drawing showing a structure of a fourth embodiment.
Figure 17:
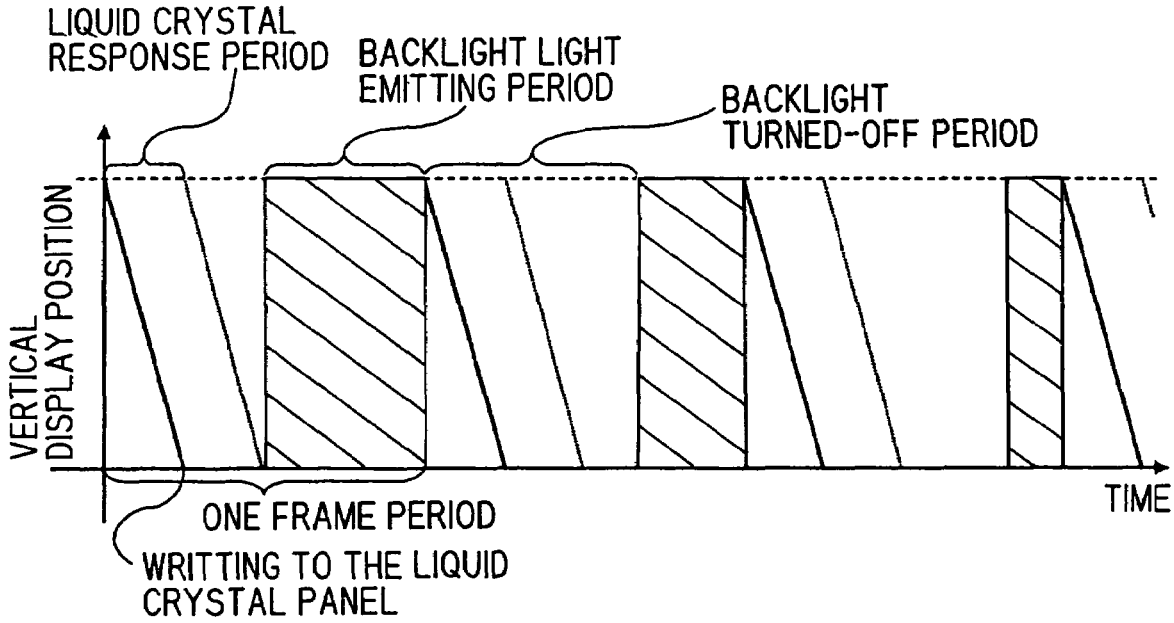
FIG. 17 is a drawing showing an operation in the fourth embodiment.

Referring now to FIG. 16 and FIG. 17, the liquid crystal display device 10 according to a fourth embodiment will be described.

(1) Structure of the Liquid Crystal Display Deivce 10

FIG. 16 shows a structure of the liquid crystal display device 10 according to the fourth embodiment of the invention.

Although the basic structure of the liquid crystal display device 10 according to the fourth embodiment is the same as the first embodiment, the fourth embodiment is characterized in that the display ratio of the input image displayed on the liquid crystal display device 10 is controlled by controlling the light-up and turn-off of the backlight 22.

With the same structure as the first embodiment, the black display time ratio is determined based on the input image. The determined black display time ratio is inputted to a backlight emission ratio/brightness control unit 28 as black display time ratio information. The backlight emission ratio/brightness control unit 28 fixes the emitting period of the backlight 22 and the luminous brightness of the backlight 22 based on the black display time ratio information, which are then inputted to the backlight 22 as backlight emission ratio control signals and backlight brightness control signals. The backlight 22 emits light based on the inputted backlight emission ratio control signals and the backlight brightness control signals.

(2) Operation of the Liquid Crystal Panel 18 and the Backlight 22

Subsequently, the operation of the liquid crystal panel 18 and the backlight 22 will be described.

FIG. 17 shows the operation of the liquid crystal panel 18 and the backlight 22. The horizontal axis of FIG. 17 represents time, and the vertical axis thereof represents the position of display on the liquid crystal panel 18 in the vertical direction. Normally, in the liquid crystal panel 18, the image is written on line-by line basis from the top of the screen in sequence.

Therefore, writing into the liquid crystal panel 18 is performed in such a manner that while the image is written on the liquid crystal panel 18 from the top of the screen the writing time is shifted little by little, as shown in FIG. 17. Writing in the liquid crystal panel 18 is normally performed in one frame period (generally 1/60 second). However, in this embodiment, in order to secure the emitting period of the backlight 22, described later, it is written in a shorter period than one frame period, that is, ¼ frame period (1/240 second). For a predetermined period until response of the liquid crystal is completed after having written the lower most line on the liquid crystal panel 18, the backlight 22 emits light according to the backlight emission ratio control signals.

The luminous brightness of the backlight 22 is determined by the backlight emitting period and is controlled so that the product of the backlight emitting period and the backlight luminous brightness is kept substantially constant.

The backlight 22 is preferably turned off during the writing period to the liquid crystal panel 18 and the response period of the liquid crystal. This is because part of the image in the previous frame is still displayed on the liquid crystal panel 18 during the writing period to the liquid crystal panel 18 and the response period of the liquid crystal, and hence the previous frame and the current frame are combined if the backlight 22 emits light and are presented to the observer.

As described above, by controlling the emitting period of the backlight 22, the black display time ratio of the liquid crystal display device 10 can be controlled as in the first embodiment.

As described above, according to the liquid crystal display device 10 of this embodiment, improvement of quality of the moving image and the still image displayed on the liquid crystal display device 10 is achieved.

Fifth Embodiment

Figure 18:
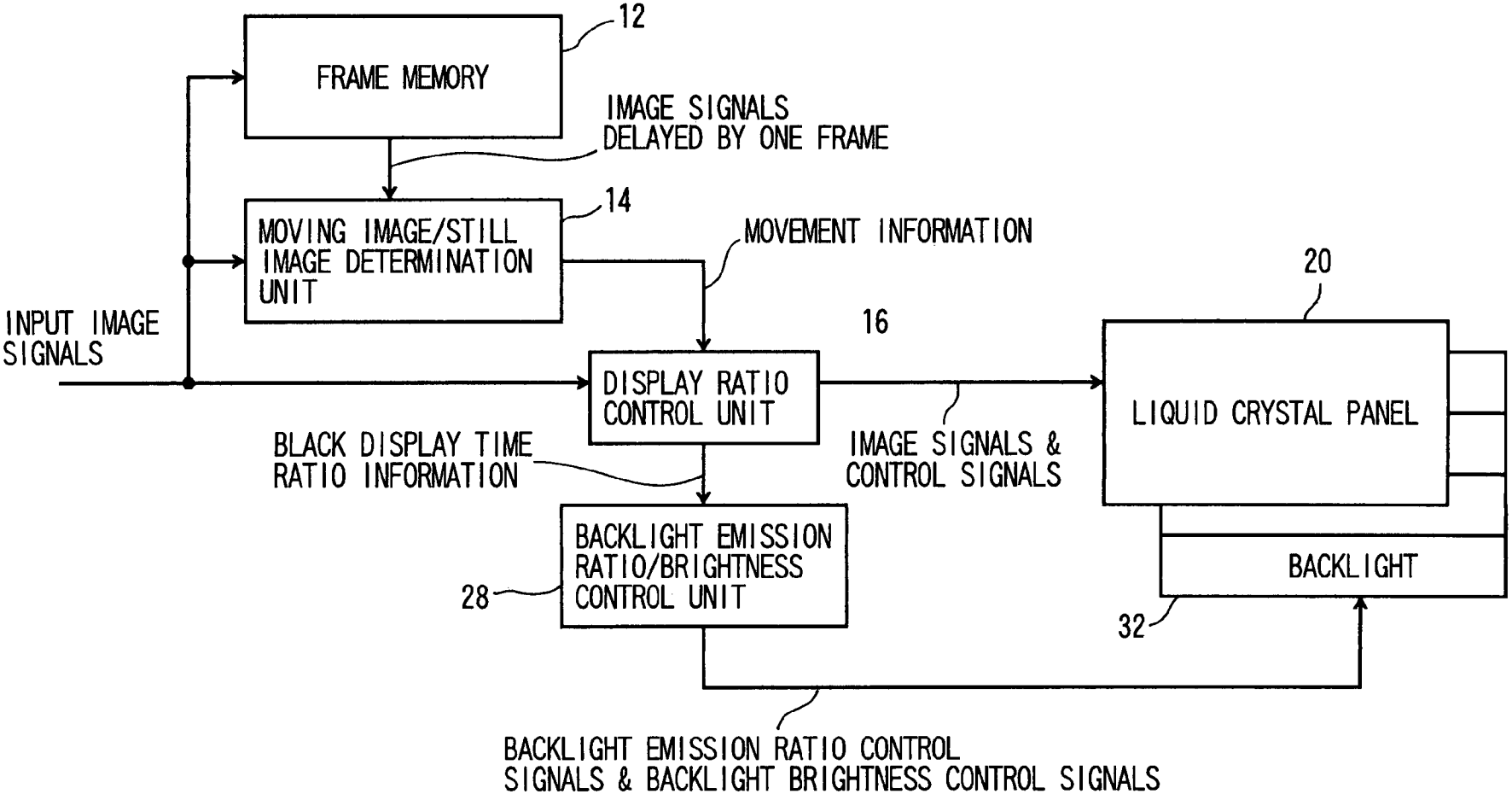
FIG. 18 is a drawing showing a structure of the liquid crystal device according a fifth embodiment.
Figure 19:
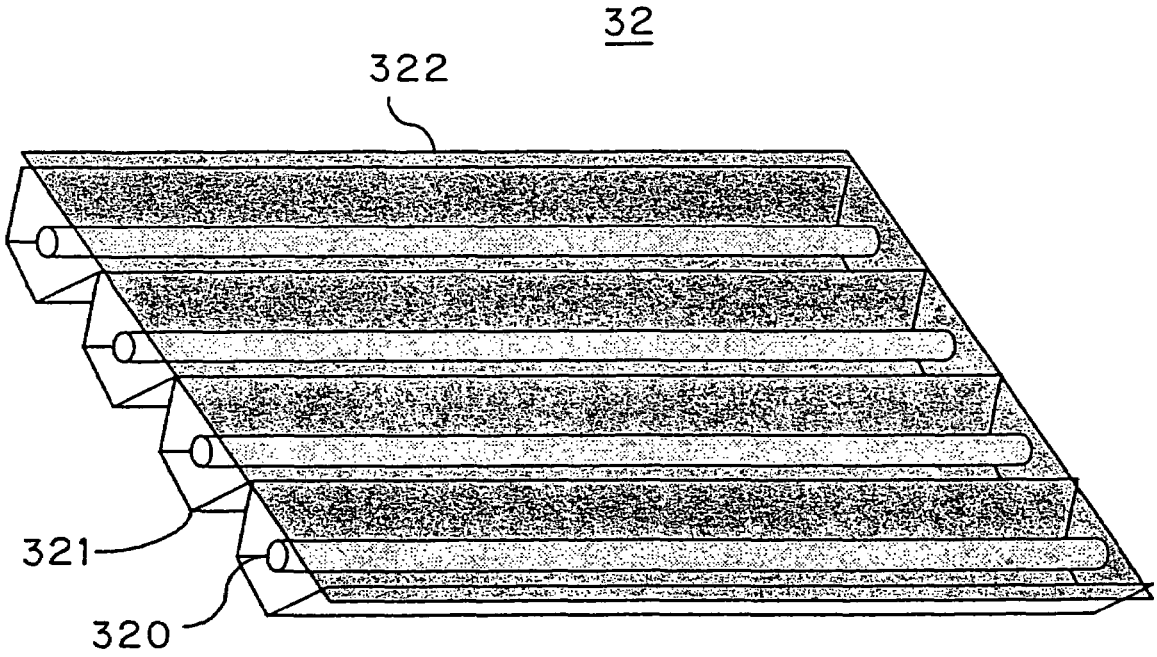
FIG. 19 is a structure of a backlight in the fifth embodiment.
Figure 20:
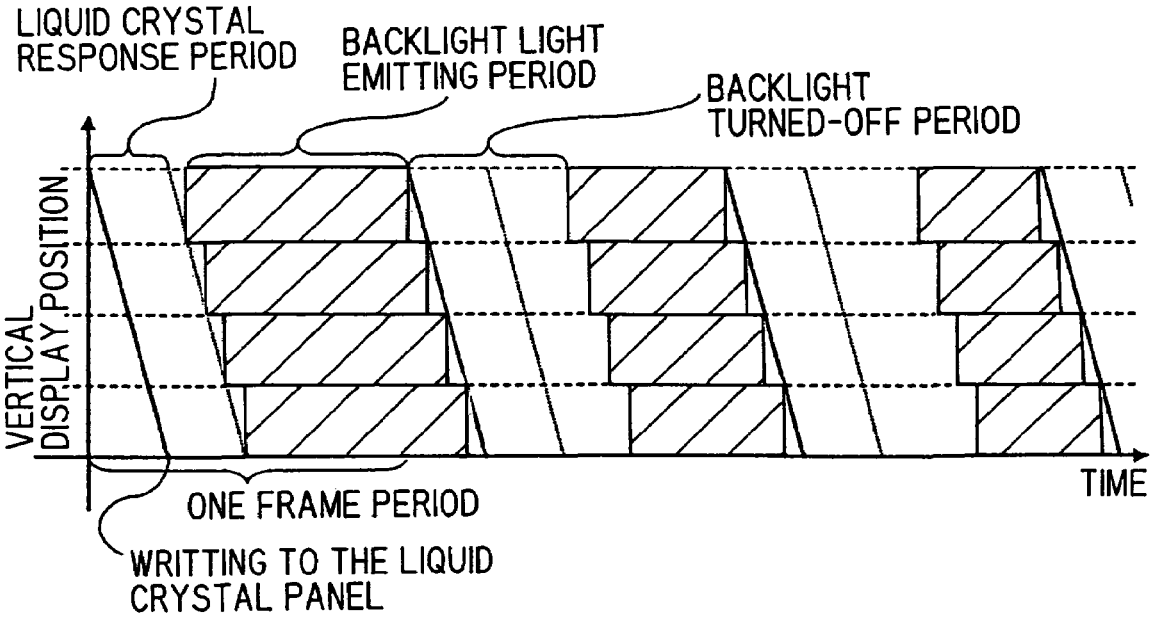
FIG. 20 is a drawing showing an operation in the fifth embodiment.

Referring now to FIG. 18 to FIG. 20, the liquid crystal display device 10 according to a fifth embodiment of the invention will be described.

(1) Structure of the Liquid Crystal Display Device 10

FIG. 18 shows a structure of the liquid crystal display device 10 according to the fifth embodiment of the invention.

Although the basic structure of the liquid crystal display device 10 according to the fifth embodiment is the same as the fourth embodiment, the fifth embodiment is characterized in that light light-emitting area of a backlight 32 is divided so that the backlight 32 can be illuminated at different timings.

FIG. 19 shows an example of the structure of the backlight 32 according to this embodiment. FIG. 19 is a structure referred to as a direct backlight, and includes cold cathode tubes 320 arranged as light sources, and each cold cathode tube 320 is surrounded by a reflector plate 321. A diffusion plate 322 is mounted on top of the cold cathode tubes 320, so that light from the cold cathode tubes 320 is diffused to provide a uniform surface light source. In this embodiment, the emission timings of the respective cold cathode tubes 320 are different.

(2) Operation of the Liquid Crystal Panel 18 and the Backlight 32

The operation of the liquid crystal panel 18 and the backlight 32 will be described.

FIG. 20 shows the operation of the liquid crystal panel 18 and the backlight 32. In FIG. 20, the backlight 32 is divided along the vertical direction into four sections to form four horizontal light-emitting areas, and the respective horizontal light-emitting areas can be controlled in timing of emission and quenching of the backlight 32.

In the fourth embodiment, the timing of emission of the backlight 32 is when a predetermined period has elapsed after having written the lower most line of the liquid crystal panel 18. However, in this embodiment, the backlight 32 is turned on according to the emitting ratio control signals of the backlight 21, when the response period of the liquid crystal has elapsed after writing the lowermost line of the liquid crystal panel 18 which corresponds to one of the respective divided horizontal light-emitting areas has been completed. As described above, when the light-emitting area of the backlight 32 is divided in the horizontal direction, the emitting period of the backlight 32 can be elongated in comparison with the fourth embodiment, and hence the black display time ratio can be controlled in a larger range. Other structures are the same as the fourth embodiment.

As described above, according to the liquid crystal display device 10 in this embodiment, improvement of the quality of the moving image and the still image displayed on the liquid crystal display device 10 is achieved.

Sixth Embodiment

Figure 21:
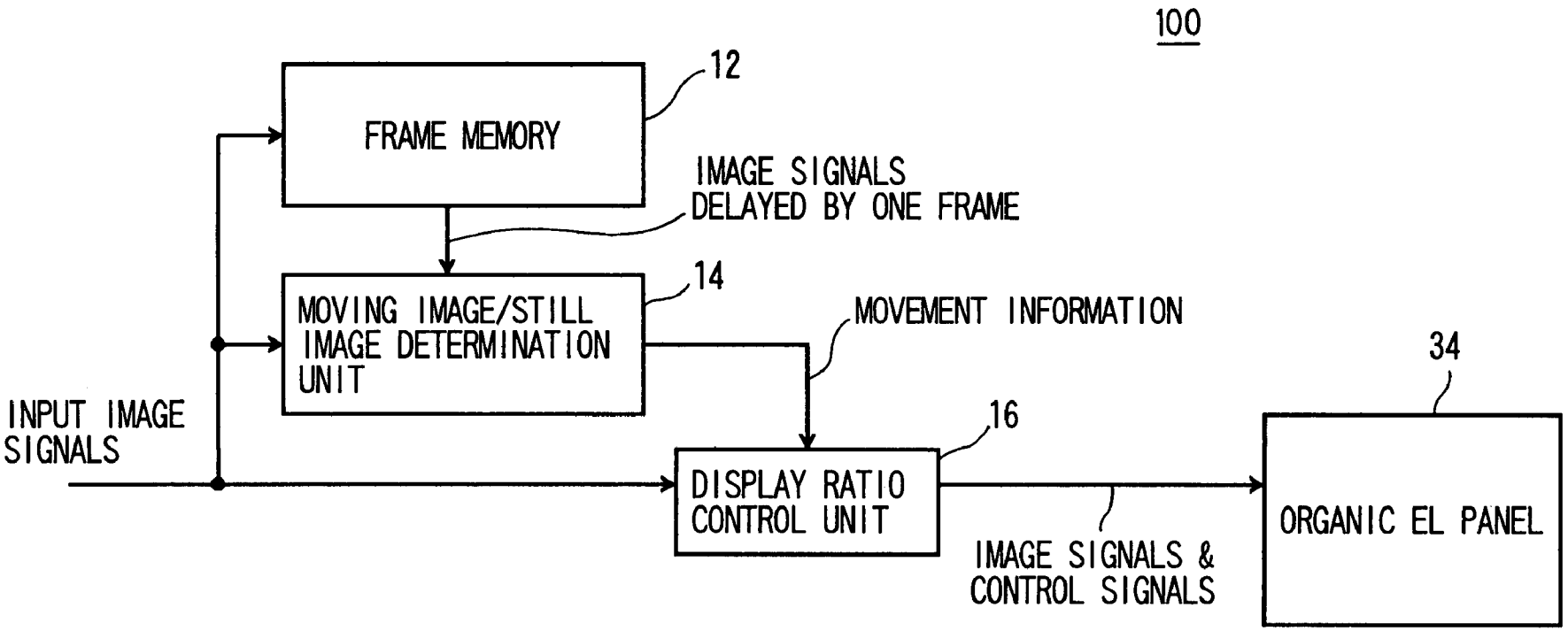
FIG. 21 is a drawing showing a structure of an organic EL display device according to a sixth embodiment.
Figure 22:
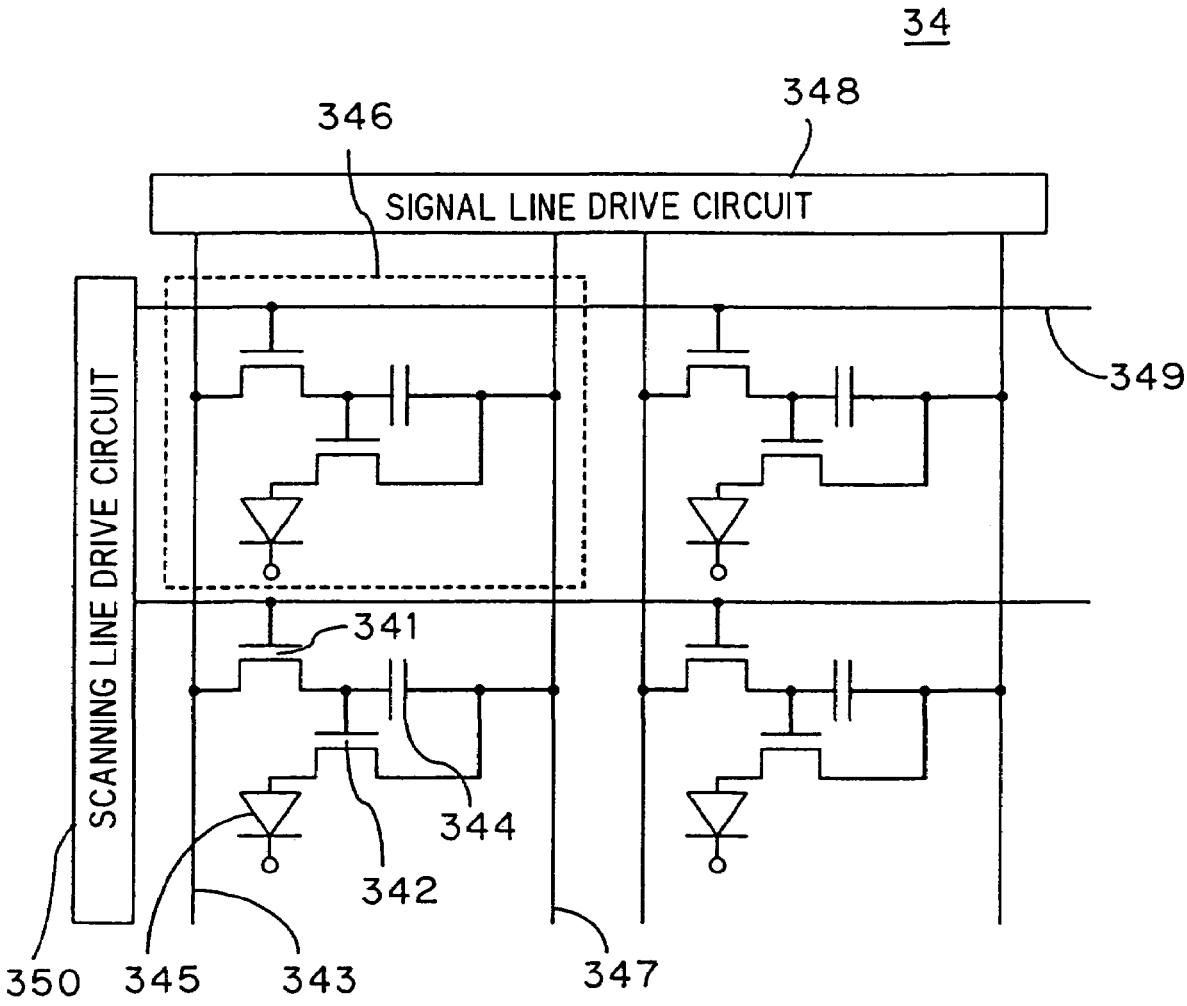
FIG. 22 is a drawing showing a structure of an organic EL panel according to the sixth embodiment.

Referring now to FIG. 21 to FIG. 22, the liquid crystal display device 10 according to a sixth embodiment will be described.

(1) Structure of an Organic EL Display Device 100

FIG. 21 shows a structure of the organic EL display device 100 according to the sixth embodiment of the invention.

Although the basic structure of the organic EL display device 100 according to the sixth embodiment is the same as the first embodiment, the image display unit is configured of an organic EL panel 34.

FIG. 22 shows an example of the structure of the organic EL panel 34.

The organic EL panel 34 includes pixels 346 each having a first switch element 341 and a second switch element 342 formed of two thin-film transistors, a voltage holding capacitor 344 for holding the voltage supplied from a signal line 343, and an organic EL element 345.

The ends of the signal line 343 and a power source line 347 are connected to a signal line drive circuit 348.

Scanning lines 349 extending in the direction orthogonal to the signal line 343 and the power source line 347 are connected to a scanning line drive circuit 350.

(3) Operation of the Organic EL Display Device 100

Subsequently, the operation of the organic EL display device 100 will be described.

The scanning line drive signals in the ON state are applied to the first switch element 341 via the scanning line 349 from the scanning line drive circuit 350, and hence the first switch element 341 is brought into the conducting state. At this time, the signal line drive signals outputted from the signal line drive circuit 348 are written in the voltage holding capacitor 344 via the signal line 343.

The conducting state of the second switch element 342 is defined according to the quantity of electric charge accumulated in the voltage holding capacity 344, and a current is supplied from the power source line 347 to the organic EL element 345, so that the organic EL element 345 emits light.

Since the voltage which defines the conducting state of the second switch element 342 is accumulated in the voltage holding capacity 344, even when the scanning line drive signals are turned OFF, the current is continuously supplied from the power source line 347 to the organic EL element 345.

Therefore, as in FIG. 6 in conjunction with the first embodiment, the signal line drive circuit 348 outputs the image signals in the former half of the single horizontal scanning period and the black image signals in the latter half of the single horizontal scanning period, applies the ON-state scanning line drive signal synchronized with the former half of the single horizontal scanning period to the scanning line 349 to which the image signal is to be written, and applies the ON-state scanning line drive signal synchronized with the latter half of the single horizontal scanning period to the scanning line 349 for writing the black image signals, so that the image display period and the black image display period of the organic EL panel 34 can be controlled as in the first embodiment. In other words, the scanning line drive circuit 350 is controlled in the same manner as the first embodiment based on the black display time ratio determined by the display ratio control unit 16.

(4) Control Specific for the Organic EL Panel 34

However, since the organic EL panel 34 is a self-luminous element, it is necessary to control lightness of the image during the period in which the image is displayed according to the black display time ratio, and keep the brightness in one frame period substantially constant.

Therefore, lightness of the image is digitally controlled using the signal line drive circuit 348 provided with a 10-bit output accuracy in this embodiment. The state in which lightness of the image is most required is the state in which the black display time ratio shows the maximum value in the predetermined control range. In other words, since the black display time ratio is large, the period during which the image is displayed is reduced, and hence lightness of the image must be increased in order to maintain the brightness in one frame period substantially constant.

Therefore, the maximum brightness in the image display period is controlled by setting the maximum displayed gray-scale levels of the image when the black display time ratio shows the maximum value to 1020 gray-scale levels and reducing the value of the maximum displayed gray-scale levels of the image with decrease of the black display time ratio in the predetermined black display time ratio control range. In other words, assuming that γ represents a gamma value of the input image, the maximum gray-scale levels of the input image is 8 bits (255 gray-scale levels), and I represents the ratio of the brightness in the image display period at the time of black display time ratio that is desired to the brightness during the image display period at the time of the maximum black display time ratio in the black display time ratio control range, the maximum gray-scale level $L_{max}$ set when the ratio of brightness is I is formularized as Expression 27.

$$L_{max}=(I\times(255\times4)^{\gamma})^{1/\gamma} \quad \text{[Expression 27]}$$

Lightness in the image display period can be controlled by calculating the maximum gray-scale levels based on the black display time ratio by Expression 27 and then re-quantizing all the gray-scale levels of the image.

Lightness of the organic EL panel 34 can also be controlled by controlling the current value supplied by the power source line 347. Therefore, a structure in which the current value supplied by the power source line 347 is controlled so that the brightness in one frame period is kept substantially constant in response to changes is the black display time ratio can also be employed.

Other structures and operations are the same as the first embodiment.

As described thus far, according to the organic EL display device 100 of this embodiment, improvement of the quality of the moving image and the still image displayed on the organic EL display device 100 is achieved.

Modification

Although the embodiments of the invention have been described thus far, the invention is not limited to the embodiments described above, and may be implemented with various modifications without departing the scope of the invention.

For example, even when the several structural components are eliminated from the disclosed structural components, it can be construed to be the invention as long as the specific effects of the invention are achieved.

(1) Modification 1

Although description is focused on the black display time ratio in the respective embodiments, it can also be focused on the image display ratio for displaying the frame in one frame period. In other words, since a relation of "image display ratio+black display time ratio=1" is established, the same effects as the above-described embodiments can be achieved by reducing the image display ratio more for the image of larger movement, and increasing the image display ratio for the still image.

(2) Modification 2

Although description has been made about the liquid crystal display device 10 and the organic EL display device 100 in this embodiment, other devices can also improve the quality of the moving image and the still image by applying the invention as long as it is the hold-type display device which displays the moving image by continuously displaying the image for one frame period such as an inorganic EL display device.

What is claimed is:

1. An image display device comprising:

an image inputting unit configured to input an input image;

a display ratio controller which controls a black display ratio which is a ratio of a period for displaying a black image in one frame period in a frame of the input image;

a period setting unit which sets a black display period and an image display period for displaying the frame on the basis of the black display ratio;

a brightness compensator which obtains brightness compensation information for compensating brightness of the frame according to the black display ratio; and a display which displays the frame and the black image, the display ratio controller comprising:

a ratio fixer which determines the black display ratio;

a transient black display time ratio calculator which calculates a transient black display ratio, which is a ratio between the current black display ratio fixed by the ratio fixer and a new black display ratio fixed by the ratio fixer; and a transient black display time ratio setting unit which sets the black display ratio relating at least to the display of one frame from the current black display ratio to the transient black display ratio and then setting the black display ratio to the new black display ratio, wherein the display displays a brightness compensation image based on the brightness compensation information and the frame in the image display period, and displays the black image in the black display period.

2. The device according to claim 1, wherein the transient black display time ratio setting processor comprises:

a comparator which determines whether an criterion indicating the change from the current black display ratio to the new black display ratio is larger than a predetermined condition;

a first setting unit which sets the black display time ratio of at least one frame to the transient black display ratio and then setting the black display ratio to the new black display ratio when the criterion is larger than the predetermined condition; and a second setting unit which sets the black display ratio to be the new black display ratio when the criterion is smaller than the predetermined condition.

3. The device according to claim 2, wherein the transient black display time ratio calculator obtains the transient black display ratio so that absolute differences of the black display ratio between adjacent frames of the input image become smaller than a predetermined threshold, and the transient black display time ratio setting unit changes the black display ratio so that the absolute differences of the black display ratio between the adjacent frames become smaller than the predetermined threshold.

4. The device according to claim 2, wherein the transient black display time ratio calculator sets the transient black display ratio so that the absolute value of rate of change in the black display ratio between the adjacent frames of the input image become smaller than a predetermined threshold, and the transient black display time ratio setting unit changes the black display ratio so that the absolute value of the rate of change in black display ratio between the adjacent frames become smaller than the threshold.

5. The device according to claim 1 further comprising an image determiner which determines whether the input image is a moving image or a still image, wherein the ratio fixer sets the black display ratio when the input image is determined to be the moving image to be a ratio larger than the black display ratio when the input image is determined to be the still image.

6. The device according to claim 5, wherein the image determiner detects a movement of the input image, and determines the input image to be a moving image when the magnitude of the movement is larger than a predetermined threshold, and determines the input image to be a still image when the magnitude of the movement is smaller than the threshold.

7. The device according to claim 5, wherein the ratio fixer increases the new black display ratio in proportion to the magnitude of the movement.

8. The device according to claim 1, wherein the transient black display time ratio calculator obtains a plurality of different transient black display ratios based on an average gray-scale level of pixels contained in the frame of the input image.

9. The device according to claim 8, wherein the transient black display time ratio calculator obtains the plurality of different transient black display time ratios based on the average gray-scale level of the pixels having gray-scale levels from a maximum gray-scale level to a gray-scale level which is smaller than the maximum gray-scale level by a predetermined proportion.

10. The device according to claim 8, wherein the transient black display time ratio calculator determines a plurality of different transient black display ratios based on the average gray-scale level of pixels included in a range from the highest to a predetermined ranking in gray-scale level.

11. The device according to claim 8, wherein the transient black display time ratio calculator determines a plurality of different transient black display ratios based on the average gray-scale level of the n pixels with the highest gray-scale levels, n being a predetermined fraction of the whole.

12. The device according to claim 1, wherein the display comprises a liquid crystal panel and a surface light source disposed on the back side of the liquid crystal panel for illuminating the liquid crystal panel from the back surface, the brightness compensator obtains luminous brightness information of the surface light source based on the black display ratio and employs the obtained luminous brightness information as the brightness compensation information in order to control variations in integral brightness in one frame period caused by the change in the black display ratio within a predetermined range, and an image display controller which controls the luminous brightness of the surface light source based on the brightness compensation information and writes the image information of the frame on the liquid crystal panel.

13. The device according to claim 12, wherein the image display controller causes the surface light source to emit light during the image display period, and causes the surface light source to turn off for the black display period.

14. The device according to claim 12, wherein the surface light source comprises an emission switching unit which switches the surface light source, comprising a plurality of horizontal light-emitting region units which are divided in the vertical direction of the screen of the liquid crystal panel, between on and off, the liquid crystal panel comprises an image information inputting unit which inputs the image information to each horizontal line from the top or bottom of the screen on a line-by-line basis, and the image display controller writes the image information of the frame in a display area on the liquid crystal panel corresponding to the horizontal light-emitting area units, and then turns off light in the horizontal light-emitting area in the black display period and causes the horizontal light-emitting area to emit light in image display period.

15. The device according to claim 14, wherein the image display controller turns light off in the horizontal light-emitting area in the black display period and then causes the horizontal light-emitting area to emit light in the image display period, or causes the horizontal light-emitting area to emit light in the image display period and then turns off the light in the horizontal light-emitting area in black display period.

16. The device according to claim 1, wherein the display comprises an electro-luminescence panel.

17. The device according to claim 16, wherein the brightness compensator obtains maximum display gray-scale level information based on the black display ratio and employs the obtained maximum display gray-scale level information as the brightness compensation information in order to control variations in integral brightness in one frame period caused by the change in the black display ratio within a predetermined range, and an image display control processor generates the brightness compensation image using the maximum display gray-scale level information and pixel information of the frame, and displays the brightness compensation image on the electro-luminescence panel.

18. The device according to claim 16, wherein the brightness compensator calculates the electric current value to be supplied to the electro-luminescence panel and employs the obtained current value as the brightness compensation information in order to control variations in integral brightness in one frame period caused by the change in the black display ratio within a predetermined range, and an image display controller supplies a current of the current value based on the pixel information of the frame and the brightness compensation information to the electro-luminescence panel.

19. The image display device according to claim 16, wherein the transient image display ratio calculator determines the plurality of different transient image display ratios based on the average gray-scale level of the pixels having gray-scale level from a maximum gray-scale levels to a gray-scale level which is smaller than the maximum gray-scale level by a predetermined proportion.

20. The device according to claim 16, wherein the transient image display ratio calculator obtains the plurality of different transient image display ratios based on the average gray-scale level of pixels included in a range from the highest to a predetermined ranking in gray-scale level.

21. The device according to claim 16, wherein the transient image display ratio calculator obtains the plurality of different transient image display ratios based on the average gray-scale level of the n pixels with the highest gray-scale levels, n being a predetermined fraction of the whole.

22. An image display device comprising:

an image inputting unit configured to input an input image;

a display ratio controller which controls an image display ratio which is a ratio of a period for displaying the frame when the frame and the black image are displayed in one frame period of the input image;

a period setting unit which sets a black display period and an image display period for displaying the frame based on the image display ratio;

a brightness compensator which obtains brightness compensation information for compensating brightness of the frame according to the image display ratio; and a display which displays the frame and the black image, the display ratio controller comprising:

a ratio fixer which determines the image display ratio;

a transient image display ratio calculator which obtains the transient image display ratio, which is a ratio between the current image display ratio determined by the ratio fixer and a new ratio determined by the ratio fixer; and a transient image display ratio setting unit which sets the image display ratio relating at least to the display in one frame from the current image display ratio to the transient image display ratio and then setting the image display ratio to be the new image display ratio, wherein the display displays a brightness compensation image based on the brightness compensation information and the frame in the image display period, and displays a black image in a black display period.

23. The device according to claim 22, wherein the transient image display ratio setting unit comprises:

a comparator which determines whether or not an criterion indicating the change from the current image display ratio to the new image display ratio is larger than a predetermined condition;

a first setting unit which sets the image display ratio of at least one frame to be the transient image display ratio and then setting the image display ratio to be the new image display ratio, when the criterion is larger than the predetermined condition; and a second setting unit which sets the image display ratio to be the new image display ratio when the criterion is smaller than the predetermined condition.

24. The device according to claim 23, wherein the transient image display ratio calculator calculates the transient image display ratio so that absolute differences between the image display ratio of adjacent frames of the input image become smaller than a predetermined threshold, and the transient image display ratio setting unit changes the image display ratio so that the absolute differences between the image display ratio of the adjacent frames become smaller than the predetermined threshold.

25. The device according to claim 23, wherein the transient image display ratio calculator obtains the transient image display ratio so that the absolute value of rate of change in the image display ratio of adjacent frames of the input image becomes smaller than a predetermined threshold, and the transient image display ratio setting unit changes the image display ratio so that the absolute value of the rate of change in image display ratio of adjacent frames become smaller than the threshold.

26. The device according to claim 22 further comprising an image determiner which determines whether the input image is a moving image or a still image, wherein the ratio fixer sets the image display ratio when the input image is determined to be the moving image to a ratio smaller than the image display ratio when the input image is determined to be the still image.

27. The device according to claim 26, wherein the image determiner detects a movement of the input image, and determines the input image to be the moving image when the magnitude of the movement is larger than a predetermined threshold, while determines the input image to be the still image when the magnitude of the movement is smaller than the threshold.

28. The image display device according to claim 26, wherein the ratio fixer decreases the new image display ratio in proportion to the magnitude of the movement.

29. The device according to claim 22, wherein the transient image display ratio calculator determines a plurality of different transient image display ratios based on an average gray-scale level of pixels contained in the frame of the input image.

30. The device according to claim 22, wherein the display comprises a liquid crystal panel and a surface light source disposed on the back side of the liquid crystal panel for illuminating the liquid crystal panel from the back surface, the brightness compensator obtains luminous brightness information of the surface light source based on the image display ratio, and employs the obtained luminous brightness information as the brightness compensation information in order to control variations in integral brightness in one frame period caused by the change in the image display ratio within a predetermined range, and an image display controller controls the luminous brightness of the surface light source based on the brightness compensation information and writes the image information of the frame on the liquid crystal panel.

31. The device according to claim 30, wherein the image display controller causes the surface light source to emit light for the image display period, and turns off the surface light source for the black display period.

32. The device according to claim 31, wherein the image display controllor turns off light in the horizontal light-emitting area in the black display period and then causes the horizontal light-emitting area to emit light in the image display period, or causes the horizontal light-emitting area to emit light in the image display period and then turns off the horizontal light-emitting area in black display period.

33. The device according to claim 30, wherein the surface light source comprises an emission switching unit which switches the surface light source, comprising a plurality of horizontal light-emitting region units which are divided in the vertical direction of the screen of the liquid crystal panel, between on and off, the liquid crystal panel comprises an image information inputting unit which inputs the image information to each horizontal line from the top or bottom of the screen on a line-by-line basis, and the image display controller writes the image information of the frame in a display area on the liquid crystal panel corresponding to the horizontal light-emitting area units, and turns off light in the horizontal light-emitting area in the black display period and causes the horizontal light-emitting area to emit light in the image display period.

34. The device according to claim 22, wherein the display comprises an electro-luminescence panel.

35. The device according to claim 34, wherein the brightness compensator obtains maximum display gray-scale level information based on the image display ratio, and employs the obtained maximum display gray-scale level information as the brightness compensation information in order to control variations in integral brightness in one frame period caused by the change in the image display ratio within a predetermined range, and an image display controller generates the brightness compensation image using the maximum display gray-scale level information and the pixel information of the frame, and displays the brightness compensation image on the electro-luminescence panel.

36. The device according to claim 34, wherein the brightness compensator calculates the electric current value to be supplied to the electro-luminescence panel and employs the obtained current value as the brightness compensation information in order to control variations in integral brightness in one frame period caused by the change in the image display ratio within a predetermined range, and an image display controller supplies current of the value calculated based on the pixel information of the frame and the brightness compensation information to the electro-luminescence panel.

37. A method of displaying an image comprising:

an image input step of inputting an input image;

a display ratio control step of controlling a black display ratio which is a ratio of a period for displaying black image in one frame period in a frame of the input image;

a period setting step of setting a black display period and an image display period of displaying the frame from the black display ratio;

a brightness compensation step of obtaining brightness compensation information for compensating brightness of the frame according to the black display ratio; and an image display step of displaying the frame and the black image, the display ratio control step comprising:

a ratio fixing step of determining the black display ratio;

a transient black display time ratio calculating step of obtaining the transient black display time ratio, which is a ratio between the current black display ratio, determined in the ratio fixing step, and a new black display ratio determined in the ratio fixing step; and a transient black display time ratio setting step of setting the black display time ratio relating at least to the display in one frame from the current black display time ratio to the transient black display time ratio and then setting the black display time ratio to the new black display time ratio, wherein the image display step displays a brightness compensation image based on the brightness compensation information and the frame in the image display period, and displays a black image in the black display period.

38. A method of displaying an image comprising:

an image input step for inputting an input image;

a display ratio control step of controlling an image display ratio which is a ratio of a period for displaying black image in one frame period in the frame of the input image;

a period setting step of setting a black display period and an image display period for displaying the frame from the image display ratio;

a brightness compensation step of obtaining brightness compensation information for compensating brightness of the frame according to the black display time ratio; and an image display step of displaying the frame and the black image, the display ratio control step comprising:

a ratio fixing step of fixing the image display ratio;

a transient image display ratio calculating step of obtaining the transient image display ratio, which is a ratio between a current black display time ratio fixed in the ratio fixing step and a new black display time ratio fixed in the ratio fixing step; and a transient image display ratio setting step of setting the image display ratio relating at least to the display in one frame from the current image display ratio to the transient black display time ratio and then setting to the new black display time ratio, wherein the image display step displays a brightness compensation image based on the brightness compensation information and the frame in the image display period, and displays a black image in the black display period.

* * * * *